US009428878B2

(12) United States Patent
Hammer

(10) Patent No.: US 9,428,878 B2
(45) Date of Patent: Aug. 30, 2016

(54) RETAINING WALL SYSTEM

(71) Applicant: Westblock Systems, Inc., Tacoma, WA (US)

(72) Inventor: James E. Hammer, University Place, WA (US)

(73) Assignee: Westblock Systems, Inc., Tacoma, WA (US)

( * ) Notice: Subject to any disclaimer, the term of this patent is extended or adjusted under 35 U.S.C. 154(b) by 16 days.

(21) Appl. No.: 13/897,095

(22) Filed: May 17, 2013

(65) Prior Publication Data

US 2013/0315679 A1 Nov. 28, 2013

Related U.S. Application Data

(60) Provisional application No. 61/799,563, filed on Mar. 15, 2013, provisional application No. 61/650,310, filed on May 22, 2012.

(51) Int. Cl.
*E02D 29/02* (2006.01)

(52) U.S. Cl.
CPC ..... *E02D 29/02* (2013.01); *E02D 29/0216* (2013.01); *E02D 29/0266* (2013.01)

(58) Field of Classification Search
CPC . E02D 29/02; E02D 29/025; E02D 29/0241; E02D 29/0266; E02D 29/0225; E02D 17/205; E02D 29/0233
USPC ..... 405/272, 282, 283, 286, 284; 52/603, 52/604, 606, 596
See application file for complete search history.

(56) References Cited

U.S. PATENT DOCUMENTS 4,379,659 A * 4/1983 Steiner ..... E02B 3/14 405/284
4,619,560 A * 10/1986 Crinnion ..... E02D 29/025 405/284
4,923,339 A * 5/1990 Smith ..... 405/284
5,177,925 A * 1/1993 Winkler ..... E02D 29/025 405/284
5,224,801 A * 7/1993 Quaney ..... E02D 17/205 405/273
5,350,256 A 9/1994 Hammer
5,505,034 A * 4/1996 Dueck ..... E02D 29/025 405/286
5,878,545 A * 3/1999 Gebhart ..... E04B 2/8623 52/309.11
6,821,058 B1 * 11/2004 Dawson ..... E02D 29/025 405/284
7,410,328 B2 * 8/2008 Hamel ..... 405/286
7,503,729 B2 3/2009 Hammer et al.

(Continued)

OTHER PUBLICATIONS

Recon Retaining Wall Systems, "Recon "Series 50"—Shapes Catalog," 7pp. (Jul. 2010).

(Continued)

*Primary Examiner* — John Kreck
*Assistant Examiner* — Carib Oquendo
(74) *Attorney, Agent, or Firm* — Klarquist Sparkman, LLP

(57) ABSTRACT

Disclosed herein are embodiments of a retaining wall system, as well as embodiments of blocks and other devices for use in a retaining wall system. In some embodiments, a retaining wall includes a plurality of face blocks and a plurality of trunk blocks arranged in a plurality of courses of blocks. In some embodiments, a face block can include a face portion and a pair of leg portions, and each of the leg portions can be adapted to be coupled to a trunk block. In some embodiments, various block connecting devices can be used to connect blocks in a single course of blocks and various block alignment devices can be used to align blocks in adjacent courses.

22 Claims, 21 Drawing Sheets

(56) References Cited

U.S. PATENT DOCUMENTS

| | | | | |
|---|---|---|---|---|
| 7,553,109 | B2 | 6/2009 | Blundell | |
| D611,165 | S | 3/2010 | Hammer | |
| D611,166 | S | 3/2010 | Hammer | |
| 7,775,747 | B2 * | 8/2010 | Bott | 405/286 |
| 7,794,180 | B2 | 9/2010 | Blundell | |
| 7,866,923 | B2 * | 1/2011 | Knudson et al. | 405/284 |
| 8,104,996 | B2 * | 1/2012 | Goebel et al. | 405/284 |
| 2011/0150579 | A1 * | 6/2011 | Knudson et al. | 405/284 |
| 2013/0049259 | A1 | 2/2013 | Hammer | |

OTHER PUBLICATIONS

Rosetta, "The Look and Feel of Nature—Product Catalog," 11p. (Feb. 2011).
Lock + Load Retaining Walls, "Construction Procedures, 2011 Rev. 1.5," 11p. (Feb. 2011).
Ultrablock, "Installation Tips," 1p. (Aug. 2011).
Lock + Load Retaining Walls, "Construction Procedures, 2006 Rev. 1.2," 11p. (2006).

* cited by examiner

RETAINING WALL SYSTEM

CROSS REFERENCE TO RELATED APPLICATIONS

This application claims the benefit of U.S. Provisional Patent Application Nos. 61/650,310, filed May 22, 2012, and 61/799,563, filed Mar. 15, 2013, which are each hereby incorporated herein by reference.

FIELD

The present application relates to embodiments of a retaining wall system.

BACKGROUND

Concrete blocks, such as used to construct retaining walls, can either be "pre-cast," also known as "wet-cast," or "dry-cast" blocks. Wet-cast blocks are blocks that are formed from concrete having a water-cement ratio of about 0.4 or higher. In the wet-casting process, the concrete must cure in the mold before it is removed, usually by disassembling the mold. In contrast, dry-cast blocks are formed from "zero-slump" concrete, typically using a high speed block-forming machine.

The main advantage of dry casting is that concrete components can be mass produced at a high rate using a block-forming machine. Since the blocks can be stripped from the mold immediately (without curing), a single mold can be used to mass produce a specific component at a much greater rate than is possible with wet casting. The size, shape and texture of dry-cast blocks however are limited by the block-forming machine and the equipment used to convey and store the blocks during the curing process, such as the pallets that support the blocks after they are removed from the mold. For example, most block-forming machines are not compatible with a mold greater than 12 inches in height. In addition, blocks greater than 24 inches in width or depth tend to cause the pallets supporting the uncured blocks (after being removed from the mold) to deflect under the weight of the blocks, allowing the blocks to deform. Thus, concrete blocks having greater dimensions typically must be manufactured using a wet-casting process.

The main advantage of wet-cast blocks is that the concrete has a higher density, lower porosity, and higher cement to aggregate ratio, resulting in higher freeze-thaw resistance than dry-cast blocks. As such, wet-cast blocks are preferred or required in geographic areas where the blocks frequently are exposed to freeze-thaw conditions. Another advantage of wet casting is that the blocks can be molded to have virtually any size, shape and/or texture.

There are several known wet-cast retaining wall systems that are used to construct structural retaining walls. These systems tend to include massive, wet-cast concrete blocks that weigh several thousands of pounds. As can be appreciated, such blocks are expensive to produce and are much more difficult to transport to a jobsite and install compared to relatively smaller dry-cast retaining wall blocks.

What is needed is a wet-cast retaining wall system having blocks that are easier to produce, transport and install and provide greater flexibility in the types of construction techniques that can be used to construct walls.

SUMMARY

Disclosed herein are embodiments of a retaining wall system, as well as embodiments of blocks and other devices for use in a retaining wall system. In some embodiments, a retaining wall includes a plurality of face blocks and a plurality of trunk blocks arranged in a plurality of courses of blocks. In some embodiments, a face block can include a face portion and a pair of leg portions, and each of the leg portions can be adapted to be coupled to a trunk block. In some embodiments, various block connecting devices can be used to connect blocks in a single course of blocks and various block alignment devices can be used to align blocks in adjacent courses.

In some embodiments, a wall block assembly comprises a face block and a trunk block. The face block can comprise a face portion and first and second leg portions formed integrally with the face portion, wherein each leg portion extends away from the face portion to a rear portion of the leg portion. The trunk block can comprise first and second end portions and an intermediate portion which interconnects the first and second end portions. The first end portion can be connected to the rear portion of the first leg portion and the second end portion can be connected to the rear portion of the second leg portion. The face portion, first leg portion, second leg portion, and the trunk block define an enclosed space in a horizontal plane to receive backfill material. The face block and the trunk block can comprise either wet-cast or dry-cast concrete.

In particular embodiments, the wall block assembly can further comprise a first connecting element connecting the rear portion of the first leg portion of the face block to the first end portion of the trunk block, and/or a second connecting element connecting the rear portion of the second leg portion of the face block to the second end portion of the trunk block. Each of the rear portions of the first and second leg portions of the face block can comprise two ridges in an upper surface of the leg portion and a slot defined between the two ridges adapted to receive a respective connecting element. Each of the first and second end portions of the trunk block can comprise at least one slot in an upper surface of the end portion. The first connecting element can be disposed in the slots of the first leg portion and the first end portion of the trunk block, and the second connecting element can be disposed in the slots of the second leg portion and the second end portion of the trunk block.

In some embodiments, the first connecting element comprises first and second end portions, with the first end portion being configured to engage at least one of the ridges of the first leg portion, and the second end portion being configured to engage an adjacent surface of the trunk block as to resist lateral separation of the face block and the trunk block. The second connecting element similarly can comprise first and second end portions configured to engage adjacent surfaces of the second leg portion and the trunk block. In some embodiments, each of the rear portions of the first and second leg portions of the face block can further comprise a respective pocket defined between the two ridges wherein the pocket has a width which is greater than a width of the slot defined between the two ridges.

In some embodiments, a wall block assembly comprises a face block comprising a face portion and first and second leg portions formed integrally with the face portion, wherein each leg portion extends away from the face portion to a rear portion of the leg portion. The wall block assembly can further comprise a first trunk block comprising first and second end portions and an intermediate portion which interconnects the first and second end portions. The first end portion is coupled to the rear portion of the first leg portion. A second trunk block comprises first and second end portions and an intermediate portion which interconnects the first and second end portions. The first end portion of the second trunk block can be coupled to the rear portion of the second leg portion of the face block.

In some embodiments, the first and second leg portions of the face block extend from quarter points of the face portion of the face block. In some embodiments, a wall block assembly can further comprise first and second upper pockets formed in a top surface of the face block and first and second lower pockets formed in a bottom surface of the face block. The pockets can be situated at respective quarter points of the face block. When forming courses of a wall, the first and second upper pockets receive the lower portions of respective block-connecting elements and the first and second lower pockets are placed over the upper portions of respective block-connecting elements of blocks in a lower course. In other embodiments the face block can be formed with integral nubs, or projections, formed in the upper surface of the face block, rather than first and second upper pockets. The nubs are configured to be positioned in the lower pockets of blocks in a vertically adjacent course.

In some embodiments, a method of assembling a wall block assembly comprises positioning a face block in a desired position, wherein the face block comprises a face portion and first and second leg portions formed integrally with the face portion, wherein each leg portion extends away from the face portion to a rear portion of the leg portion. A trunk block is placed in a desired position relative to the face block such that the rear portion of the first leg portion is adjacent to a first end portion of the trunk block and the rear portion of the second leg portion is adjacent to a second end portion of the trunk block. The method can further comprise connecting the rear portion of the first leg portion to the first end portion of the trunk block and connecting the rear portion of the second leg portion to the second end portion of the trunk block.

In some embodiments, the rear portion of the first leg portion of the face block includes a slot, the first end portion of the trunk block includes a slot, and the act of connecting the rear portion of the first leg portion to the first end portion of the trunk block comprises inserting a connecting element into the slot in the rear portion of the first leg portion and the slot of the first end portion of the trunk block. In some embodiments, the rear portion of the second leg portion of the face block includes a slot, the second end portion of the trunk block includes a slot, and the act of connecting the rear portion of the second leg portion to the second end portion of the trunk block comprises inserting a connecting element into the slot in the rear portion of the second leg portion and the slot of the second end portion of the trunk block.

The foregoing and other features and advantages of the invention will become more apparent from the following detailed description, which proceeds with reference to the accompanying figures.

DETAILED DESCRIPTION

Figure 1:
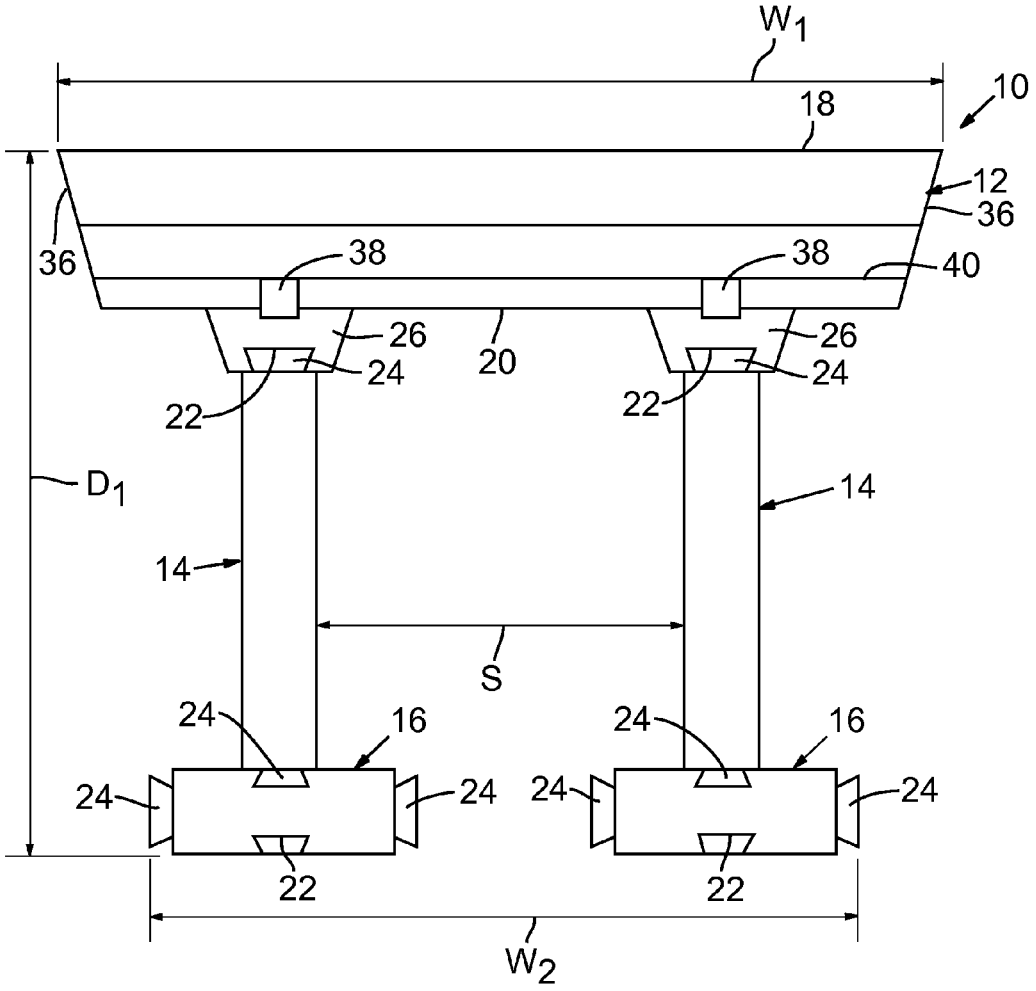
FIG. 1 shows a top plan view of a block assembly, according to one embodiment.

A retaining wall system, according to one embodiment, comprises a plurality of interlocking concrete blocks that are configured to be used together in forming block assemblies laid side-by-side in courses of a wall. FIG. 1 shows a first block assembly 10, according to one embodiment. The block assembly 10 comprises a face block 12, one or more trunk blocks 14 connected to the face block, and one or more anchor, or tail, blocks 16 connected to each of the trunk blocks. Additional blocks can be added to an assembly to increase the depth of the assembly, as further described below.

As shown, the face block 12 has a face or front surface 18 that is exposed in the front surface of a wall. The front surface 18 can be formed with any of various desired textures and/or configurations that enhance the appearance of the block. In particular embodiments, the face block 12 is a wet-cast block, which allows virtually any pattern or surface design to be molded into the front surface 18 of the block. In other embodiments, the face block 12 is a dry-cast block formed from a conventional block-forming machine. Where a block-forming machine is used, the mold can be equipped with components that texture the front surface 18 of the block as it is stripped from the mold to provide a texture to the front surface that resembles a split block. Once such process for texturing dry-cast blocks is disclosed in U.S. Pat. No. 7,100,886, which is incorporated herein by reference. In addition, the front face 18 of the face block 12 is shown as being straight, although other configurations are possible with either wet casting or dry casting. For example, the front face 18 can have a convex curved surface, a single-faceted configuration, a two-faceted configuration comprising two angled surfaces, or a three-faceted configuration comprising a center facet and two angled side surfaces extending rearwardly from respective sides of the center facet.

Each trunk block 14 is attached to the rear face 20 of the face block 12 desirably at about the quarter points of the face block (i.e., at locations along the width of the block 12 that are spaced inwardly from the sides a distance equal to about ¼ the width of the block). Each trunk block 14 extends perpendicularly from the face block 12 in the rearward direction. Each anchor block 16 is attached to the rearward end of a respective trunk block 14 so that it is parallel to the face block 12 and perpendicular to the trunk block, with the trunk block being attached to the anchor block at a vertical medial junction of the anchor block.

When constructing a wall, the face block 12, trunk blocks 14, and anchor blocks 16 are assembled to provide a block assembly 10, as depicted in FIG. 1. In the interconnected state, the components of the assembly 10 may not be disconnected or separated in any lateral direction (i.e., side-to-side or front-to-back in a wall) without breakage. The block components in the illustrated embodiment are not merely held in place by frictional forces and the presence of adjacent unconnected blocks. Each block component is securely mechanically engaged to at least one other adjacent block component of the same block assembly 10.

In particular embodiments, the face block 12, trunk blocks 14, and anchor blocks 16 are interconnected by dovetail joints so that they may be separated only by vertically sliding one block component with respect to an attached block component. A dovetail joint may be formed in any of a wide variety of geometries as long as the block components are connected against lateral separation. Dovetail joints generally have a male key or tongue 24 that mates with a female slot or groove 22. Typically, the tongue is wider at some position toward its free end than at another position closer to its root. The female groove 22 is configured to closely conform to the male shape of a tongue 24. In the illustrated embodiment, the face block 12 and anchor block 16 define the vertical grooves 22, which are generally trapezoidal, with the face being wider than the aperture at the surface of each block. Compatible male tongues 24 are integrally formed on the ends of the trunk block 14, with the free end being wider than the root. The grooves 22 on the face block 12 can be formed in respective projections 26 extending vertically the height of the block and rearwardly from the rear face 20. In other embodiments, the grooves 22 can be formed directly in the rear face 20 of the block (such as with the corner block 200 shown in FIG. 6).

Although less desirable, the face block and the trunk blocks can be formed as a single unit that is connected to a separable anchor block(s). In a similar manner, each trunk block and a respective anchor block can be formed as a single unit that is connected to a separable face block.

The groove 22 desirably does not pass entirely through the block, but terminates at an upwardly facing lower surface 28. Thus, the lower portion of the face block 12 is solid and unbroken by the groove 22, thereby increasing the strength of the block and decreasing the risk of breakage at the groove 22. The lower surface 28 desirably is sloped such that it faces generally upward and rearwardly of the block.

Figure 4:
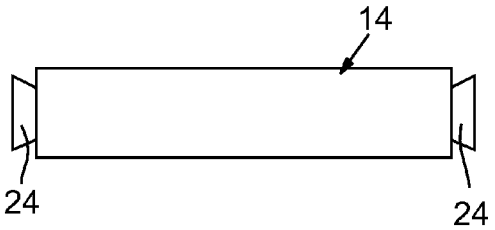
FIG. 4 is a top plan view of a trunk block of the block assembly of FIG. 1.
Figure 5:
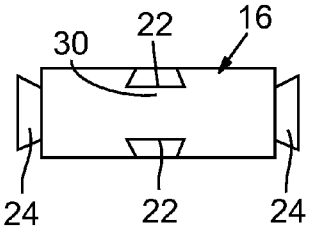
FIG. 5 is a top plan view of an anchor block of the block assembly of FIG. 1.

FIG. 4 shows the trunk block 14 with a male tongue 24 at each end of the block. Each tongue 24 desirably has a sloped lower surface corresponding to the lower surface 28 of a corresponding female groove 22 in the face block 12 or an anchor block 16. FIG. 5 is a top view of an anchor block 16. The illustrated anchor block 16 desirably is formed with a female groove 22 centrally defined on the front and rear faces according to the configuration of the grooves 22 formed in the face block 12. The grooves 22 are oriented back-to-back and spaced apart by a solid web 30 of block material to provide adequate strength. The anchor block 16 also may be formed with a male tongue 24 on each end, as depicted in FIG. 5. This allows the anchor block 16 to be optionally used as a trunk block to provide a block assembly having an overall depth that is shorter than the depth of the block assembly 10 shown in FIG. 1. The tongues 24 and grooves 22 can all be similarly tapered along their vertical lengths so that each dovetail joint is secured against excess motion and slippage by the respective tongue 24 being wedged into the respective groove 22.

Figure 2:
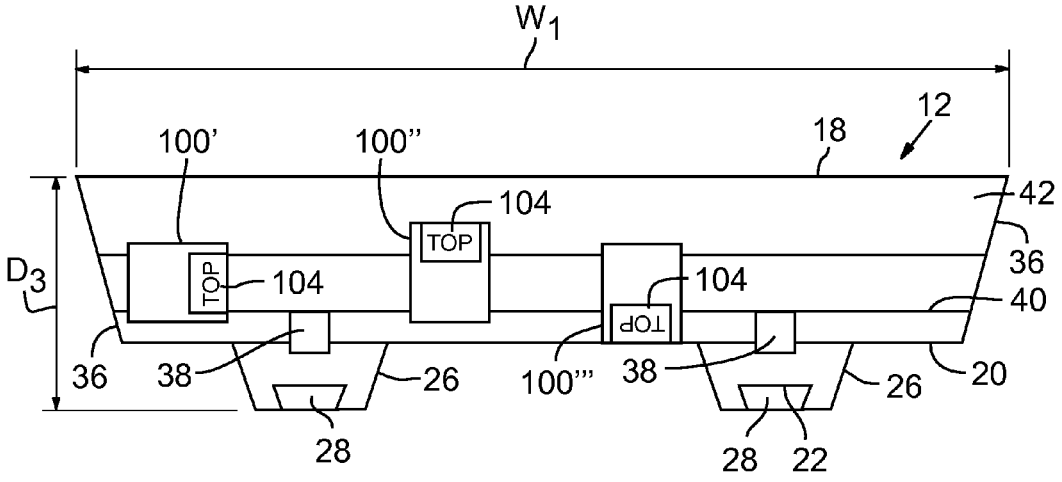
FIG. 2 is a top plan view of the face block of the block assembly of FIG. 1.
Figure 3:
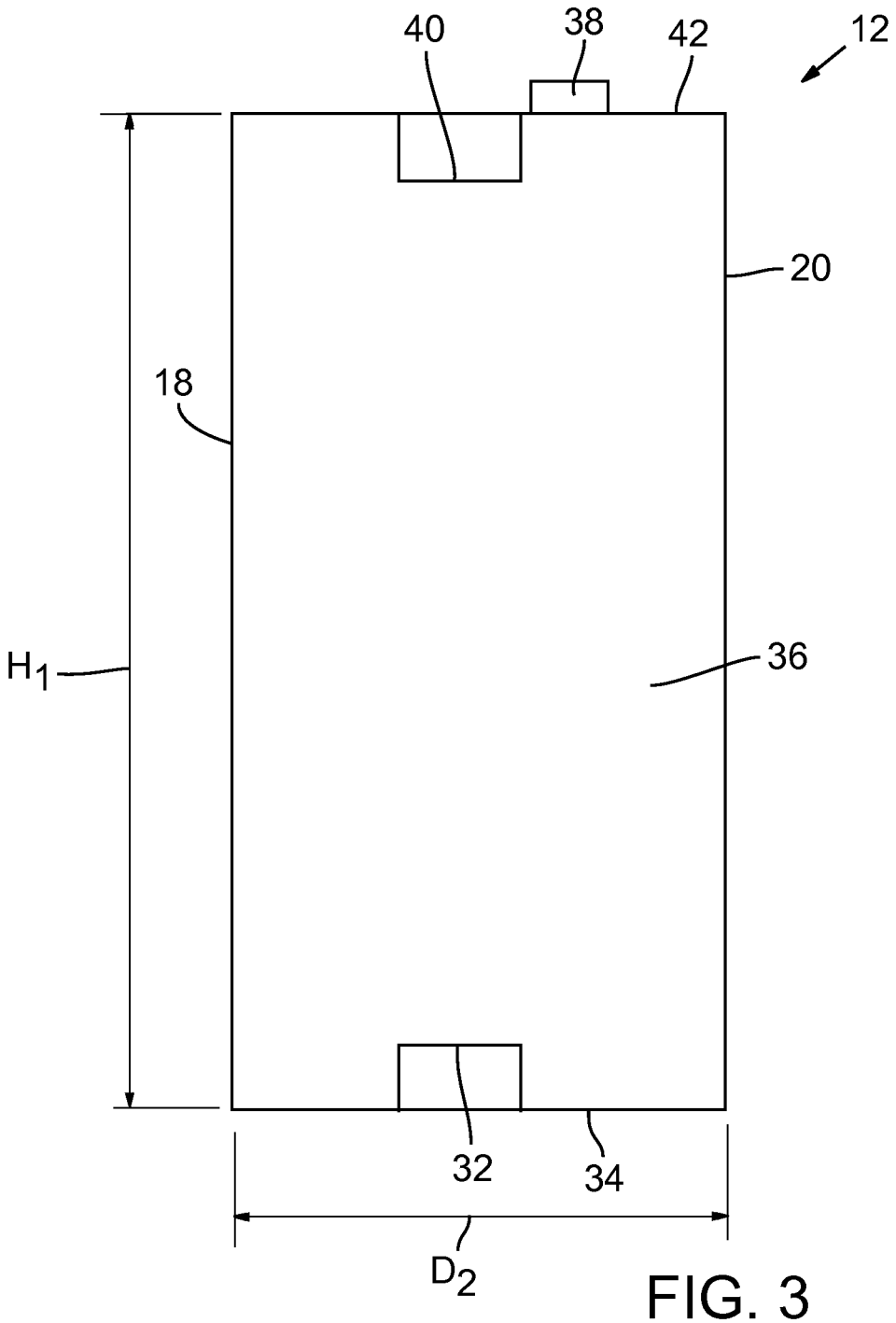
FIG. 3 shows a side elevation view of the face block of the block assembly of FIG. 1.
Figure 7:
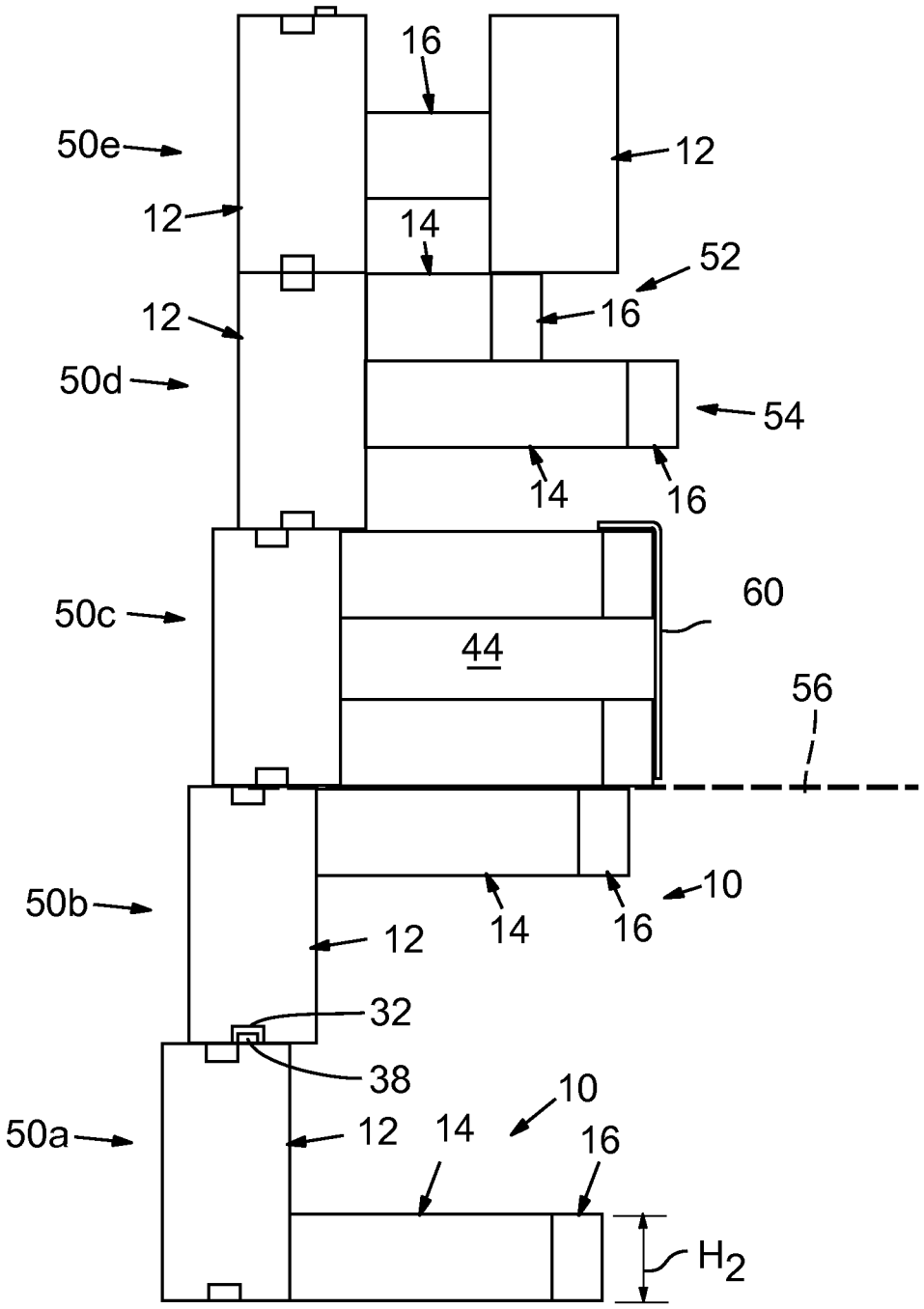
FIG. 7 is a side cross-sectional view of a wall constructed from multiple block assemblies of the type shown in FIG. 1.

Referring to FIGS. 1-3, the face block 12 can be formed with a channel 32 in its lower surface 34. The channel 32 extends parallel to the width of the block and desirably extends the entire block width, thereby opening at the sides 36 of the block. The face block 12 can also be formed with one or more alignment nubs, or projections, 38 that are configured to be received by and extend into a channel 32 of an overlying block in a wall. In other words, when face blocks 12 are stacked on top of each other to form the courses of a wall, the alignment nubs 38 of a block extend into a channel 32 of an overlying block. The channel 32 and the nubs 38 serve two main purposes: they assist in achieving the desired alignment of blocks in the vertical direction and serve as a connection between two vertically adjacent blocks that resists lateral shear forces acting on the blocks. The nubs 38 desirably are offset toward the rear face 20 of the face block in order to create a set back or positive batter wall. Referring to FIG. 7, for example, a wall comprises multiple courses 50*a*, 50*b*, 50*c*, 50*d*, 50*e*. As can be seen with respect to the first and second courses 50*a*, 50*b*, respectively, the nub 38 of the face block 12 in the first course 50*a* extends into the channel 32 of the face block 12 of the second course. Since the nub is offset toward the rear of the block, the face block 12 of the second course 50*b* is slightly set back with respect to the face block 12 of the first course 50*a*, creating a positive batter.

For purposes of illustration, the face block 12 is also shown with a channel 40 in its upper surface 42. The channel 40 is adapted to receive a separate block-connecting element 100 (FIGS. 11-16) that can be used as an alignment device and for interconnecting vertically adjacent blocks, in lieu of or in addition to the alignment nubs 38. The use of block-connecting elements 100 in the construction of a wall is described in detail below. Where alignment nubs 38 are provided, the channel 40 in the upper surface and the block-connecting elements 100 can be optional. Conversely, where block-connecting elements 100 are used, the nubs 38 can be optional.

Figure 10:
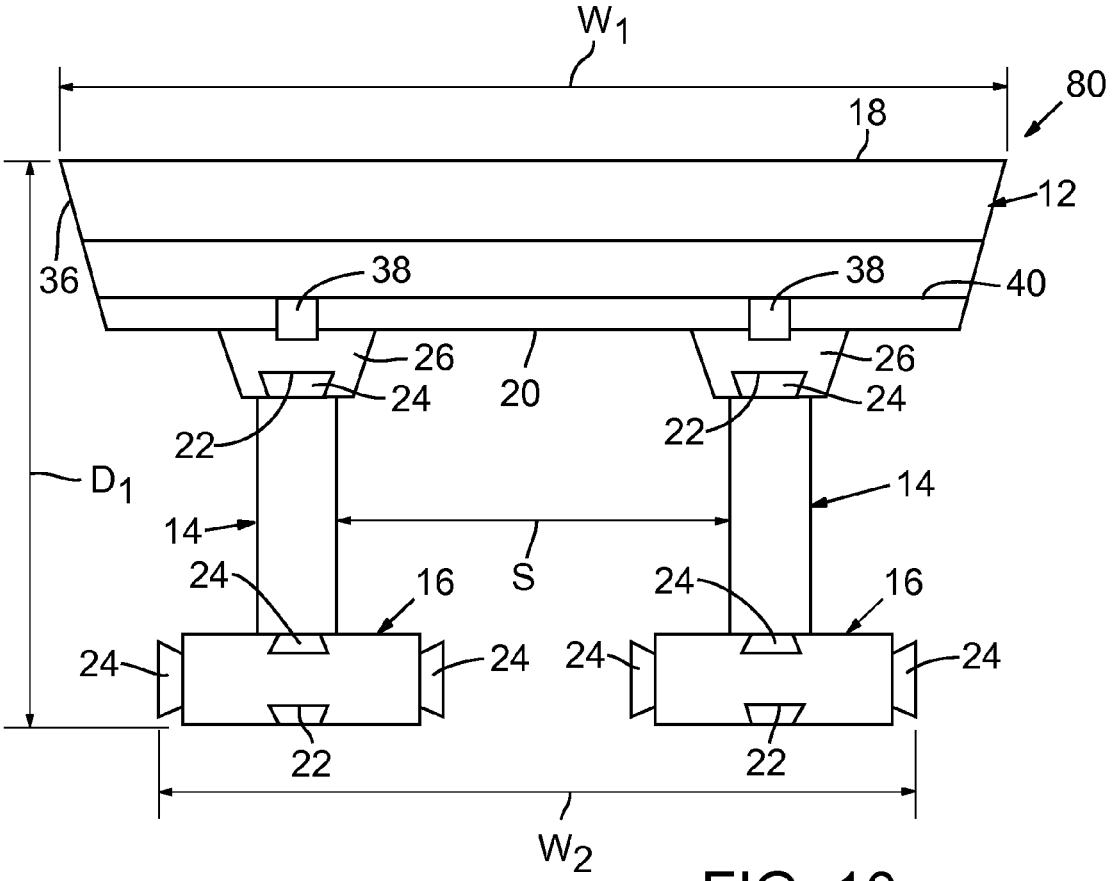
FIG. 10 is a top plan view of a block assembly, according to another embodiment.
Figure 11:
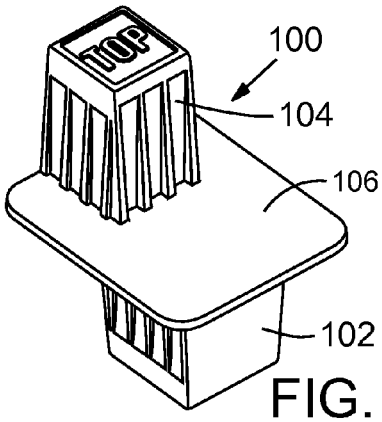
FIGS. 11-16 are various views of a block-connecting element that can be used to interconnect two blocks in adjacent courses.
Figure 12:
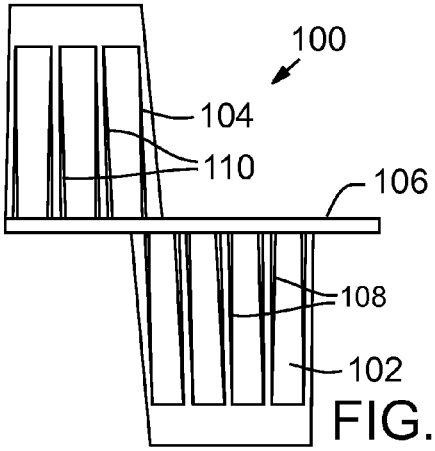
Figure 13:
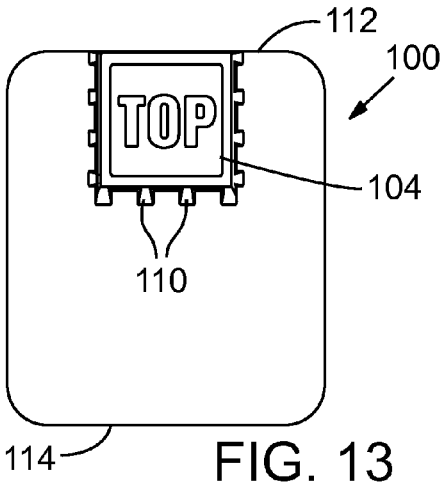
Figure 14:
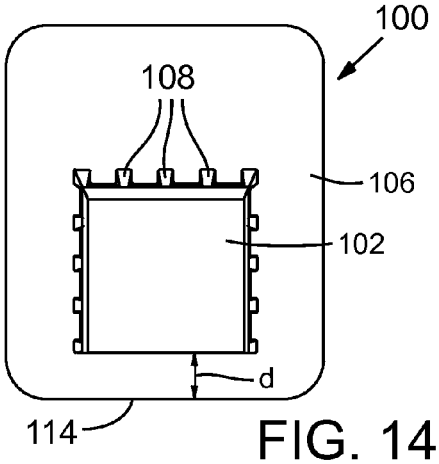
Figure 15:
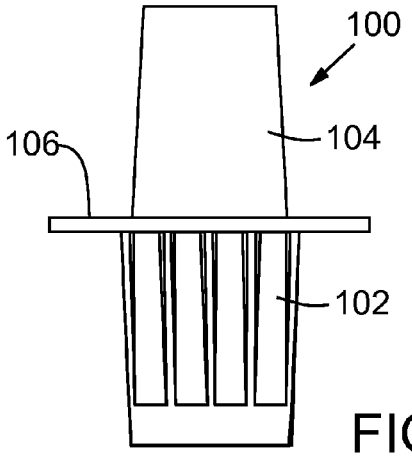
Figure 16:
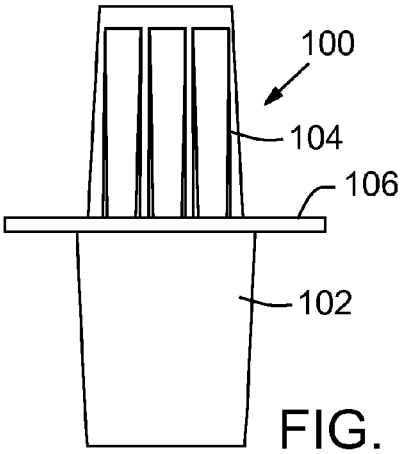

In the embodiment of FIG. 1, the trunk blocks 14 are longer than the anchor blocks 16, although this need not be the case. FIG. 10, for example, shows a block assembly 80 in which the trunk blocks 14 and the anchor the blocks 16 have the same length. Thus, the block assembly 80 has a depth $D_1$ that is less than the depth $D_1$ of the block assembly 10 shown in FIG. 1. Shorter trunk blocks may be utilized when less stabilization is required. In particular embodiments, a single block can be utilized as a trunk block and an anchor block, so long as it is provided with male tongues 24 on its opposite ends (for use as a trunk block) and female grooves 22 on opposite sides (for use as an anchor block).

Figure 6:
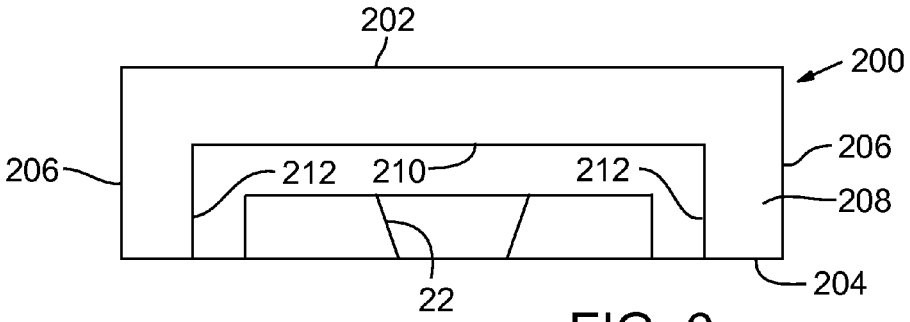
FIG. 6 is a top plan view of a corner face block that can be used in the block assembly of FIG. 1.

FIG. 6 shows an example of a corner face block 200 that can be used in place of a standard face block 12 in the block assembly. The corner block 200 can be used to form 90-degree corners in a wall. The corner block 200 has a front face 202, a rear face 204, and opposing side walls 206 extending between respective ends of the front face and the rear face at right angles with respect to the front and rear faces. The rear face 204 can be formed with a centrally located female groove 22 adapted to receive the male tongue 24 of a trunk block 14. The upper surface 208 of the corner block can be formed with a main channel 210 extending lengthwise of the block and two side channels 212 extending from the ends of the main channel to the rear face 204 of the block. The block 200 can also be formed with similar channels (not shown) in the lower surface of the block. The channels in the upper and lower surfaces can be used with a block-connecting element (e.g., block-connecting element 100 of FIGS. 11-16) to interconnect a corner face block 200 with other corner face blocks or other standard face blocks 12 in an overlying or underlying course. Alternatively, the corner face block 200 optionally can be formed with nubs 38 on its upper surface (similar to block 12) that are received in the channel in the lower surface of another block 200 or a block 12.

Figure 8:
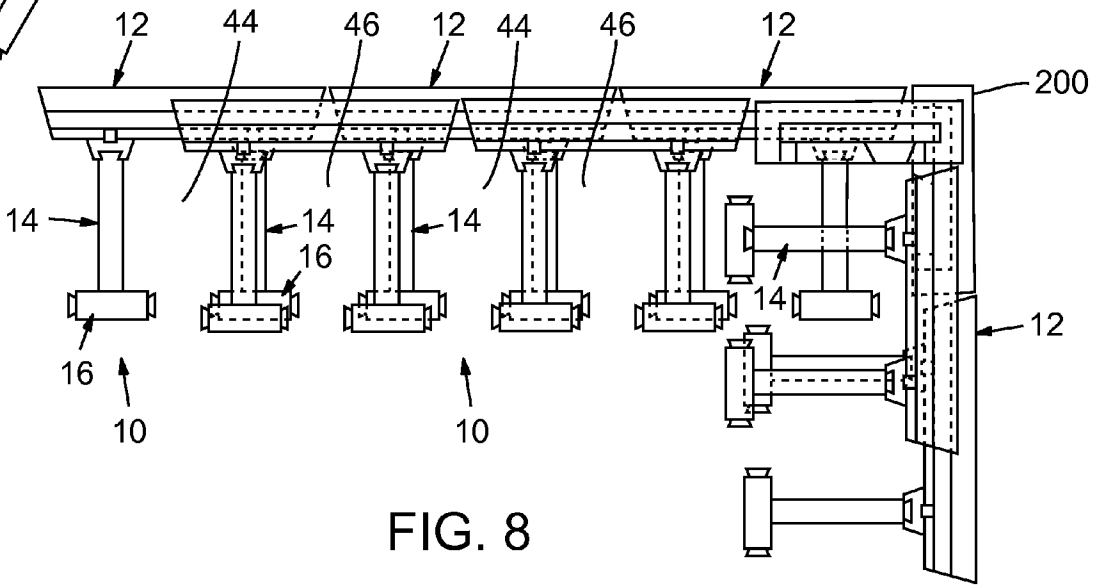
FIG. 8 is a top plan view of a wall constructed from multiple block assemblies of the type shown in FIG. 1.

FIG. 8 shows the construction of a wall using multiple block assemblies 10. As shown, the block assemblies 10 are placed side-by-side with respect to each other in each course so that their trunk blocks 14 are generally parallel and the face blocks 12 are positioned side-by-side in a continuous line. Each pair of trunk blocks 14 of a single block assembly 10 defines a generally rectangular void or chamber 44 suitable for filling with a suitable backfill material (desirably aggregate and/or earth) to provide stability and drainage. In addition, each pair of adjacent assemblies 10 defines another generally rectangular void or chamber 46 suitable for filling with a suitable backfill material. Each chamber 46 is defined at its sides by trunk blocks 14 of adjacent assemblies 10 and at its front and rear by the face blocks 12 and anchor blocks 16 of the respective assemblies.

As noted above, each course may be set back by a small distance with respect to an adjacent lower course to create a slightly sloping wall face, although in other implementations the successive courses can be vertically aligned to form a vertical wall without a setback. Nonetheless, each face block 12 rests on two face blocks 12 of a lower layer in a running bond pattern, each trunk block 14 rests on a trunk block 14 of a lower layer, and each anchor block 16 rests on an anchor block 16 of a lower layer. FIG. 8 also shows the use of a corner face block 200 in the block assemblies at the corner of the wall, which forms a 90-degree corner where the two sides of the wall meet.

Figure 9:
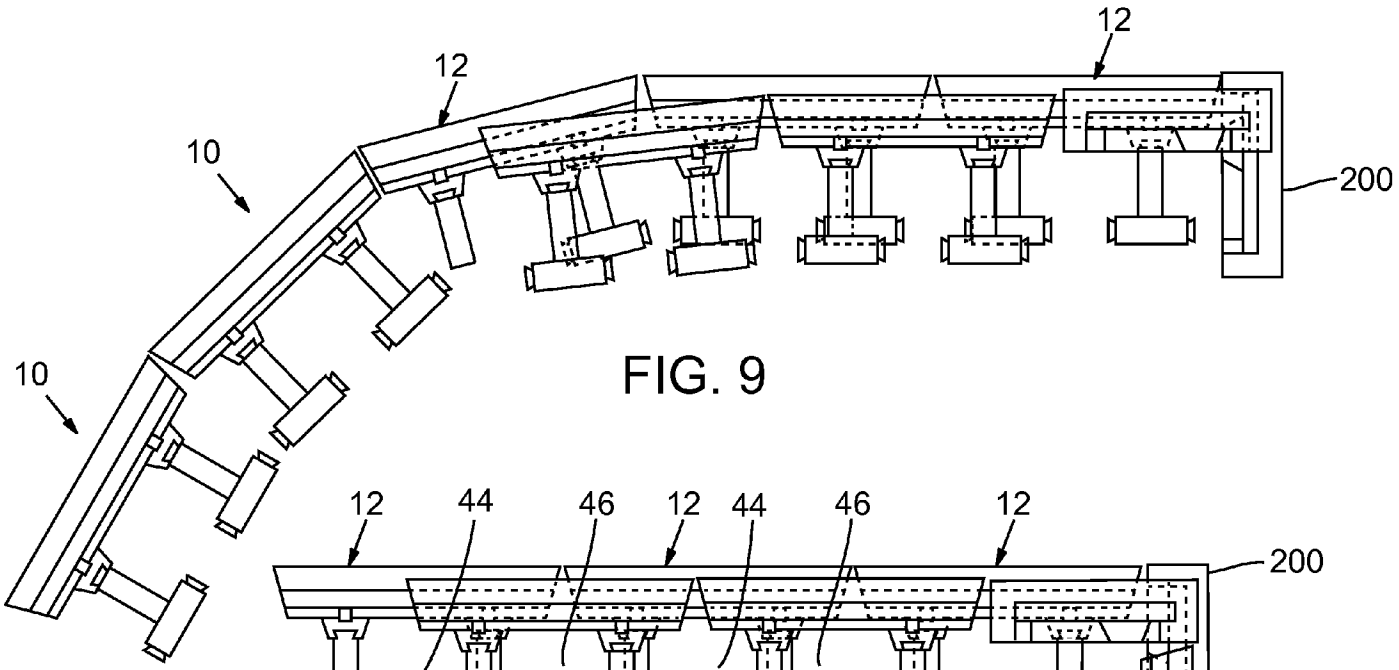
FIG. 9 is a top plan view of a convex curved wall constructed from multiple block assemblies of the type shown in FIG. 1.

As best shown in FIG. 1, the block assembly 10 has a width $W_1$ at the front of the assembly equal to width of the front surface 18 of face block 12 and defined between the side surfaces 36. The block assembly 10 has a width $W_2$ at the rear of the assembly defined between the outermost tongues 24 of the two anchor blocks 16. The width $W_1$ desirably is greater than the width $W_2$ so that convex curved walls may be formed by bringing together anchor blocks 16 of adjacent block assemblies 10 in a course closer than a parallel spacing would ordinarily dictate. A convex wall formed from block assemblies 10 is shown in FIG. 9. To form a concave wall, the anchor blocks 16 in adjacent assemblies 10 are spaced apart wider than ordinarily dictated when forming a straight wall.

As further shown in FIG. 1, each block assembly 10 has a depth $D_1$ defined by the distance between the front surface 18 of the front block 12 and the rear surface of anchor blocks 16. For additional anchoring stability in a wall, particularly in the lower layers of walls having several layers, the depths of the assemblies 10 may be extended in the rearward direction by attaching one or more additional blocks to the anchor blocks 16. As can be seen, each anchor block 16 includes an additional groove 22 on its rear surface opposite the trunk block 14. An additional trunk block 14 can be connected to each anchor block by inserting the tongue 24 of the additional trunk block in the unoccupied groove 22 of the anchor block. An additional anchor block 16 can be connected to each newly added trunk block by inserting the rear tongue 24 of each newly added trunk block into a groove 22 of the additional anchor block. The depth of the block assembly 10 can be extended as needed by adding additional trunk blocks and anchor blocks as needed to satisfy the engineering requirements of the wall. U.S. Pat.

No. 7,503,729, which is incorporated herein by reference, further illustrates the technique of extending the depth of a block assembly.

As noted above, the face block 12 can be a wet-cast block, which allows the block to have dimensions much larger than a dry-cast block produced by a conventional block-forming machine. For example, in a specific embodiment, the face block 12 has a height $H_1$ (FIG. 3) of about 24 inches, a width $W_1$ (FIG. 1) of about 48 inches, an overall depth $D_3$ (FIG. 2) of about 12 inches and depth $D_2$ (FIG. 3) (between the front and rear faces) of about 10 inches. Since the face block 12 is exposed in the front surface of a wall, providing a wet-cast face block provides the additional advantage of enhanced freeze-thaw resistance compared to a dry-cast block. On the other hand, the trunk and anchor blocks need not be as massive as the face block to serve their function of anchoring the block assembly in its respective course in the wall. The anchor and trunk blocks therefore can be much smaller and lighter than the face block. Furthermore, since the anchor and trunk blocks are buried within the earth behind the face blocks, the anchor and trunk blocks are much less susceptible to damage caused by freeze-thaw conditions. As such, the anchor and trunk blocks desirably comprise dry-cast blocks that are manufactured using a conventional block-forming machine. In this manner, the block assembly 10 effectively combines the advantages of wet-cast and dry-cast blocks by utilizing a wet-cast face block and dry-cast anchor and trunk blocks.

In a specific embodiment, the trunk blocks 14 have a spacing S of about 24 inches, which typically corresponds to the maximum spacing allowed by most building codes. Additionally, the spacing between trunk blocks 14 of adjacent block assemblies is about 24 inches. In this manner, the block system provides for more efficient wall construction since the trunk blocks will automatically achieve the proper spacing between trunk blocks connected to the same face block 12 and between trunk blocks of adjacent block assemblies 10. Similarly, most codes would allow for a 24-inch vertical spacing between trunk blocks. Providing a face block 12 having a height $H_1$ of 24 inches assists the installer achieve the proper vertical spacing between trunk blocks 14.

In particular embodiments, the face block 12 has a height $H_1$ that is greater than the height $H_2$ (FIG. 7) of the trunk blocks 14 and the anchor blocks 16. In certain embodiments, the height $H_1$ is at least 1.3 times, at least 2.0 times, at least 3.0 times, or at least 4.0 times the height $H_2$. In a specific implementation, the face block 12 has a height $H_1$ of about 24 inches, and the anchor and trunk blocks 14, 16 have a height $H_2$ of about 8 inches.

The relatively shorter anchor and trunk blocks provide several advantages, as illustrated in FIG. 7. As shown, face blocks, which are the tallest units, define the lower and upper limits of each course. The anchor and trunk blocks, which are shorter than the height of a course, can be positioned at any vertical location of the corresponding course to accommodate the presence of utilities or other obstacles behind the wall. For example, the anchor and trunk blocks of the first course 50*a* are shown positioned at the very bottom of the course while the anchor and trunk blocks of the second course 50*b* are shown at the very top of the course. The anchor and trunk blocks can also be positioned at any vertical position between the top and bottom of the course.

A single face block 12 can be connected to multiple subassemblies of trunk and anchor blocks at different vertical locations in the same course. As shown with respect to course 50*d*, the face block 12 in this course is connected to an upper subassembly 52 stacked on top of a lower subassembly 54. Each subassembly 52, 54 comprises at least one pair of a trunk block 14 and an anchor block 16 as described above, and desirably includes at least two pairs of a trunk block 14 and an anchor block 16 (e.g., as shown in FIG. 1). In the illustrated configuration, the face block 12 is tall enough to allow yet a third subassembly of trunk and anchor blocks to be connected to the face block in a stacked arrangement with the other subassemblies. Utilizing still taller face blocks 12 would allow even more anchor and trunk subassemblies to be connected to the same face block in a stacked configuration. If desired, the trunk and anchor block subassemblies in the same course need not be stacked directly on top of each other and instead can be separated in the vertical direction by backfill material that is used to fill the voids between the trunk and anchor blocks. For example, the lowermost subassembly 54 in course 50*d* can be placed at the lowermost location in the course and separated from the uppermost subassembly 52 by a layer of backfill material. In addition, each of the upper and lower subassemblies 52, 54 can have one or more additional sets of trunk and anchor blocks extending rearwardly to increase the overall depth of the block assembly.

Notably, the backfill used to fill in the voids between the trunk and anchor blocks need not be precisely compacted and leveled during wall construction. The face blocks 12, which define the upper and lower limits of each course, are stacked on top of each other, not the backfill material. The trunk and anchor blocks are set on top of a layer of backfill material at the bottom of the course, the top of the course, or at a location between the top and bottom of the course. Typically, a wall under construction must be backfilled and compacted every 8 inches. For a wall having 24-inch tall face blocks and 8-inch tall trunk and anchor blocks, each course is backfilled three times, allowing the trunk and anchor blocks to be set on top of a layer of backfill material at the bottom of the course, the top of the course or at the middle of the course. Since the trunk and anchor blocks do not define the upper and lower limits of the course, and instead "float" on backfill material between the upper and lower limits of the course, the backfill material need not be precisely compacted and leveled to ensure that each course of the wall is level.

As noted above, the face block 12 can be molded in a wet-casting process, and therefore can have relatively large height and width dimensions. Such large wet-cast blocks may be desired for a particular job site for a number of reasons. For example, the number of individual blocks and courses increases as the overall height and length of the wall increase. Thus, for very tall walls, an installer may prefer to utilize tall blocks (e.g., blocks 24 inches in height or greater) and applicable construction techniques over much smaller dry-cast blocks. A significant disadvantage of large wet-cast blocks, of course, is that they are difficult to store and transport to a job site due to their massive size. Advantageously, the use of anchor and trunk blocks, which add depth to the block assembly and effectively anchor the block assemblies in their respective courses, can effectively minimize the overall size and weight of the face block 12. In other words, the face block 12 can have a depth $D_3$ (FIG. 2) that is much less than the height $H_1$ and width $W_1$ due to the presence of the anchor and trunk blocks, which effectively minimizes the overall size and weight of the block. Thus, the face block can satisfy the need of the installer to have a block with large height and width dimensions, yet the overall size and weight is reduced, which reduces manufacturing, storage and transportation costs and facilitates installation of the blocks.

In one specific implementation, for example, the face block 12 can have a height $H_1$ of about 24 inches, a width $W_1$ of about 48 inches, a depth $D_3$ of about 12 inches (measured from the front face to the rear surface of projections 26), and weighs about 970 lbs. Comparatively, a block having the same height and width dimensions that does not utilize anchor and trunk blocks for stabilization typically would require at least twice the depth and have at least twice the weight.

Referring again to FIG. 7, a wall can include a tie-back sheet 56 (also known as geogrid) to reinforce one or more courses of the wall. As shown, the tie-back sheet is positioned between two courses and extends rearwardly into the backfill material behind the wall. The tie-back sheet 56 typically comprises a flexible, polymeric sheet of material (e.g., a sheet of polyester) having preformed openings or strips of material assembled in a grid-like pattern. The front edge of the tie-back sheet 56 can be placed between the upper surface of one face block 12 and the lower surface of an overlying face block 12 and is held in place by the weight of the overlying face block. The nubs 38 of the lower face block can be positioned in openings in the front edge portion of the tie-back sheet 56 to assist in retaining the tie-back sheet in place. Where a tie-back sheet is used between two courses, the trunk and anchor blocks of the lower course (course 50*b* in this case) can be placed at the top of their respective course while the trunk and anchor blocks of the upper course (course 50*c* in this case) can be placed at the bottom of their respective course. In this manner, the tie-back sheet is also frictionally retained by the weight of the trunk and anchor blocks in course 50*c* bearing on the trunk and anchor blocks in course 50*b*.

In some installations, some or all of the courses of a wall can be constructed from face blocks 12 without any trunk and anchor blocks. A tie-back sheet 56 typically is installed between selected adjacent courses to stabilize the wall. Providing face blocks 12 with a depth $D_3$ of at least 10 inches and preferably about 11-12 inches provides sufficient block surface area for contacting a tie-back sheet 56 placed between courses and sufficient block depth to allow various face patterns or geometries to be cast into the front surface of the block.

During construction of a wall, the voids or chambers 44, 46 formed by the blocks assemblies 10 typically are backfilled with aggregate material (e.g., crushed stone) to ensure sufficient drainage behind the front of the wall, while the space behind the block assemblies 10 and embankment is backfilled with soil. It is known to separate zones containing aggregate material and soil with a sheet of flexible material commonly referred to as filter fabric, typically made of porous fabric material. Referring to FIG. 7, the anchor blocks 16 provide a convenient support on which a separating sheet 60 can be placed or draped to separate the zone of each course filled with aggregate (within voids 44, 46) and the zone behind the block assemblies 10 which is filled with soil. The horizontal spacing between adjacent anchor blocks 16 within the same course (e.g., about 12 inches) is such that anchor blocks can support the separating sheet 60 without it tearing.

As noted above, the face blocks 12 can be formed without nubs 38 and instead can be interconnected to each other using separate block-connecting elements, which can be made of a suitable polymer, composite (e.g., fiberglass or carbon fiber composite), metal, or various other suitable materials. In use, a block-connecting element is placed in the channel 40 of a face block 12. A face block 12 in the next successive course is placed over the face block in the course below such that an upper portion of the block-connecting element extends into the channel 32 of the face block in the next successive course.

FIGS. 11-16 show one example of a block-connecting element that can be used with the block assembly 10 in the construction of a wall. The block-connecting element 100 can be referred to as a "three-way" block-connecting element (or "three-way" alignment plug) because it can be positioned in three different positions within an alignment core of a block to permit vertical, set forward, or set back placement of blocks in a course relative to the blocks in an adjacent lower course, as further described below.

As shown in FIGS. 11-16, the block-connecting element 100 comprises a lower portion, or projection, 102, an upper portion, or projection, 104, and an intermediate flange portion 106 separating the upper and lower portions. The lower portion 102 can be formed with vertically extending, spaced-apart ribs 108 that extend outwardly from one or more sides of the lower portion (e.g., in the illustrated embodiment, the ribs 108 are formed on three sides of the lower portion). The ribs 108 desirably taper in height extending in a direction from the flange portion 106 to the lower end of the lower portion 102. When inserted into a block, the ribs 108 can contact one or more inner surfaces of a core or channel of the block to assist in frictionally retaining the block-connecting element within the block. Likewise, the upper portion 104 can be formed with vertically extending, spaced-apart ribs 110 that extend outwardly from one or more sides of the upper portion (e.g., in the illustrated embodiment, the ribs 110 are formed on three sides of the upper portion). The ribs 110 desirably taper in height extending in a direction from the flange portion 106 to the upper end of the upper portion 104. When inserted into a block, the ribs 110 can contact one or more inner surfaces of a core or channel of the block to assist in frictionally retaining the block-connecting element within the block.

The upper portion 104 is horizontally offset from the lower portion 102; thus, the upper portion 104 is located closer to a forward edge 112 of the flange portion 106 and the lower portion 102 is located closer to a rear edge 114 of the flange portion 106. In the illustrated embodiment, the upper portion 104 is aligned with the forward edge 112 while the lower portion 102 is spaced slightly from the rear edge 114 by a distance d.

FIG. 2 shows the three positions of the block-connecting element 100 in a face block 12. Block-connecting element 100' is in a neutral position in which the upper portion 104 is vertically aligned with the channel 40 for constructing a substantially vertical wall (all of the courses are vertically aligned without a batter). Although not shown, the upper surface 42 of the block can be formed with a shallow recess on either side of the channel 40 so that the flange portion 106 sits flush or slightly below the upper surface 42 of the block. When constructing a vertical wall, one or more block-connecting elements 100 are positioned in a neutral position in the channel 40 of each face block 12 of the previously laid course. When forming the next course of blocks, each face block 12 being added to the wall is placed over two face blocks in the adjacent lower course in a running bond such that the upper portion 104 of each block-connecting element extends upwardly into a channel 32 of a block in the newly formed course. Because the lower portion 102 and the upper portion 104 of each block-connecting element 100 are vertically aligned with respective channels of a block below and of a block above, the blocks interconnected by the block-connecting elements are vertically aligned. FIG. 7, for example, shows course 50*d* vertically aligned with course 50*e*.

Block-connecting element 100" in FIG. 2 is in a forward position in which the upper portion 104 is offset from the channel 40 toward the front face 18 of the block for constructing a wall with negative batter. When constructing a wall with a negative batter, one or more block-connecting elements 100 are positioned in a forward position in the channel 40 of each face block 12 of the previously laid course. When forming the next course of blocks, each face block 12 being added to the wall is placed over two face blocks in the adjacent lower course in a running bond such that the upper portion 104 of each block-connecting element extends upwardly into a channel 32 of a block in the newly formed course. Because the upper portion 104 of each block-connecting element 100 is offset from the channel 40 of the previously laid course in a forward direction, the blocks of the newly formed course are set forward with respect to the blocks of the adjacent lower course.

Block-connecting element 100'" in FIG. 2 is in a rearward position in which the upper portion 104 is offset toward the rear of the face block for constructing a wall with positive batter. When constructing a wall with a positive batter, one or more block-connecting elements 100 are positioned in a rearward position in the channel 40 of each face block 12 of the previously laid course. When forming the next course of blocks, each face block being added to the wall is placed over two blocks in the adjacent lower course in a running bond such that the upper portion 104 of each block-connecting element extends upwardly into a channel 32 of a block in the newly formed course. Because the upper portion 104 of each block-connecting element 100 is offset from the channels 40 of the previously laid course in a rearward direction, the blocks of the newly formed course are set back with respect to the blocks of the adjacent lower course. FIG. 7, for example, shows course 50*c* set back relative to course 50*b*.

Figure 17:
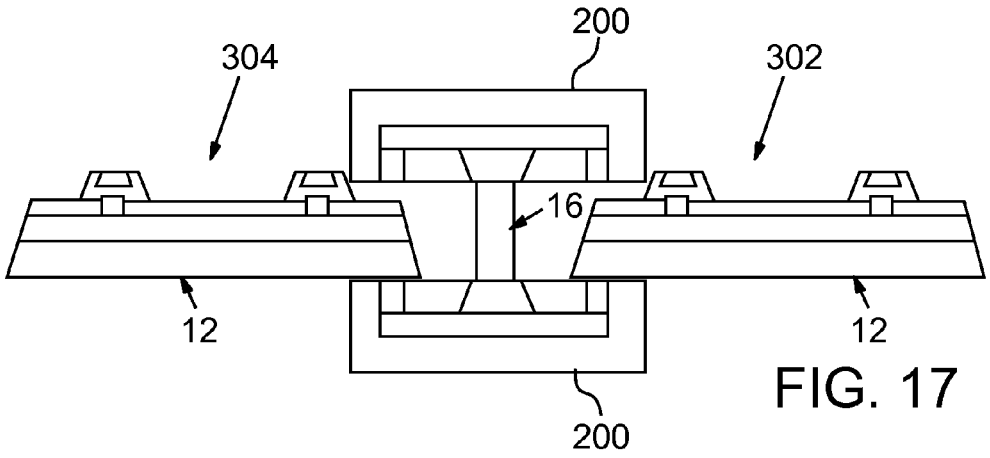
FIG. 17 is a top plan view of a pilaster, according to one embodiment.

FIG. 17 shows an example of the construction of a pilaster or column using the blocks described above. In this example, the pilaster is formed from two corner blocks 200 placed back-to-back and interconnected by a block 16. The male tongues 24 on the opposite ends of the block 16 are received in respective grooves 22 in the blocks 200. Additional layers of blocks 200 interconnected by a block 16 can be stacked on top of each other to achieve the desired height of the pilaster. The space between the blocks 200 is sufficient to allow the ends of wall sections 302, 304, each comprising stacked courses of face blocks 12, to extend into the pilaster.

Figure 18:
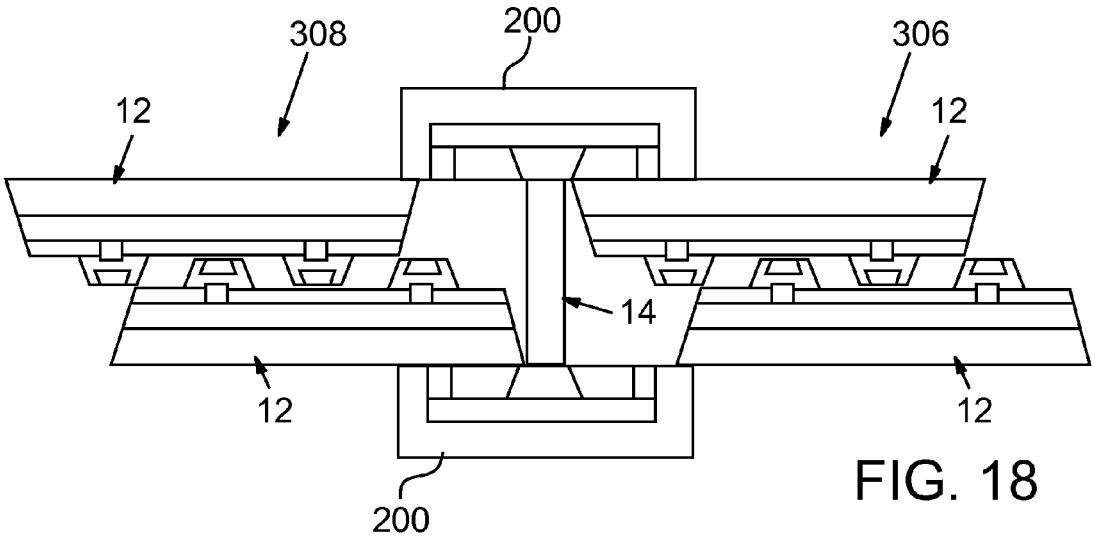
FIG. 18 is a top plan view of a pilaster, according to another embodiment.

FIG. 18 shows another example of a pilaster construction. In this example, the pilaster is formed from two blocks 200 placed back-to-back and interconnected by a block 14. The spacing between the blocks 200 is sufficient to allow the ends of wall sections 306, 308 to extend into the pilaster. Each wall section 306, 308 comprises stacked layers of two rows of face blocks 12. The wall construction shown in FIG. 18 can be used for a free-standing wall or fence (where both sides of the wall are visible).

Figure 19:
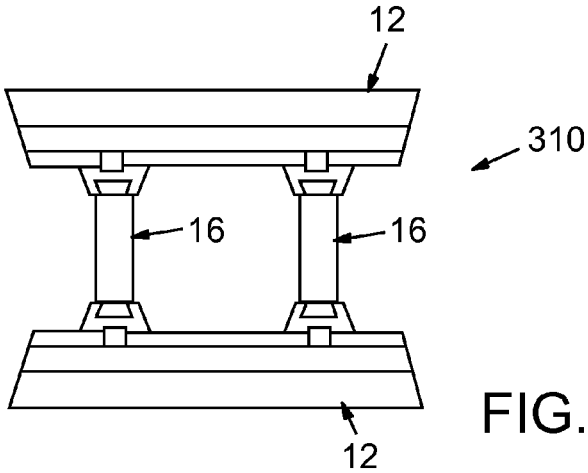
FIG. 19 is a top plan view of another embodiment of a block assembly.

FIG. 19 shows a block assembly 310 that can be a section of a free-standing wall or fence. The assembly 310 includes two face blocks 12 placed back-to-back and interconnected by two blocks 16. A course of a wall can be formed by placing multiple block assemblies 310 side-by-side with respect to each other. Course 50*e* in FIG. 7 comprises block assemblies 310, which can extend into the embankment behind the wall or can be a barrier wall placed on top of the embankment.

Figure 20:
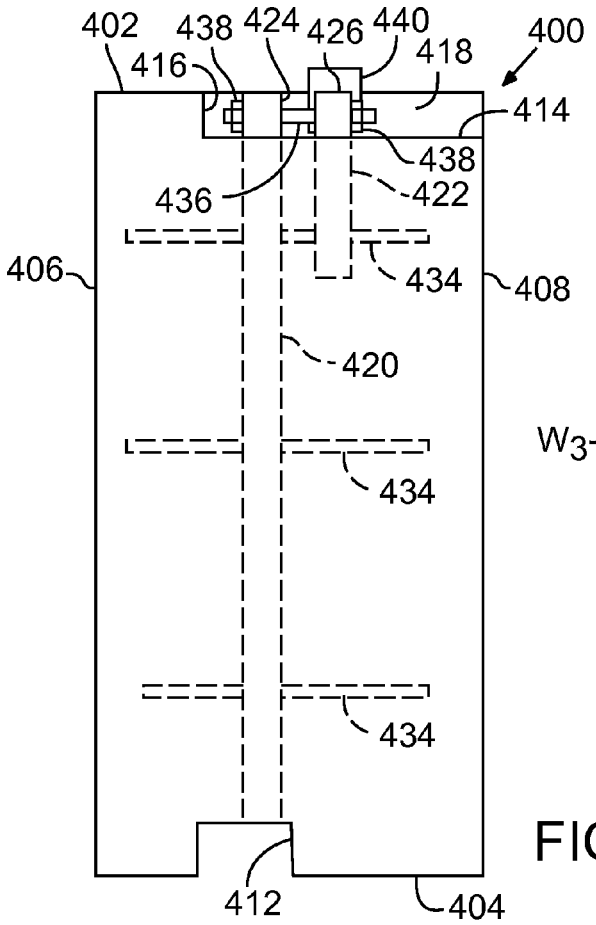
FIG. 20 is a side elevation view of a wet-cast concrete block, according to another embodiment.
Figure 21:
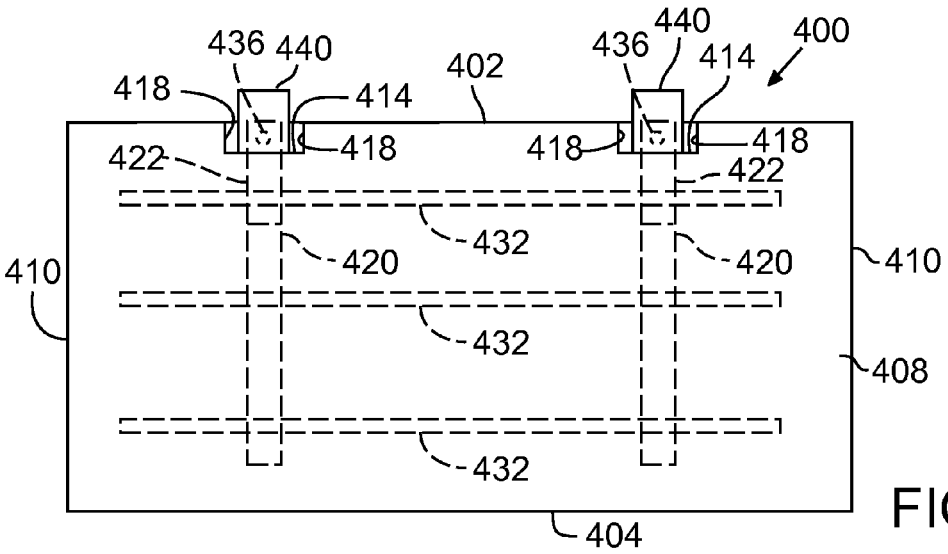
FIG. 21 is a rear elevation view of the block shown in FIG. 20.

FIGS. 20 and 21 show a wet cast block 400, according to another embodiment. The block 400 comprises upper and lower surfaces 402 and 404, respectively, opposed front and rear surfaces 406 and 408, respectively, and opposed side surfaces 410 extending from respective ends of the front surface to respective ends of the rear surface. The lower surface 404 is formed with a channel 412 that desirably extends the entire width of the block (the width being measured from one side surface to the other). The upper surface 402 is formed with one or more recessed portions or pockets 414 (two in the illustrated embodiment) spaced apart from each other in the direction of the width of the block. Each recessed portion 414 is defined by a forward wall 416 and two opposed side walls 418, and is open at the rear surface 408 of the block.

The block 400 is formed with a forward row of one or more vertical reinforcement members 420 (two in the illustrated embodiment) spaced apart from each in the direction of the width of the block and a rearward row of one or more vertical reinforcement members 422 (two in the illustrated embodiment). The rear reinforcement members 422 desirably are aligned directly behind respective forward reinforcement members 420 as shown. The forward reinforcement members 420 desirably extend substantially the entire height of the block from the upper surface 402 to a location just above the channel 412. Each forward reinforcement member 420 has an upper portion 424 that extends upwardly into the recessed portion 418 but does not extend above the upper surface 402 of the block. The rear reinforcement members 422 can be much shorter than the forward reinforcement members 420; for example, in the illustrated embodiment, the rear reinforcement members 422 are about one fifth to about one third the overall height of the block. Each rear reinforcement member 422 has an upper portion 426 that extends upwardly into the recessed portion 418 but does not extend above the upper surface 402 of the block. The height of the forward reinforcement members 420 and the rear reinforcement members 422 within the block can be varied in other embodiments. For example, in one implementation, the rear reinforcement members 422 can be longer than the forward reinforcement members 420 and therefore extend closer to the lower surface of the block than the forward reinforcement members 420.

Figure 22:
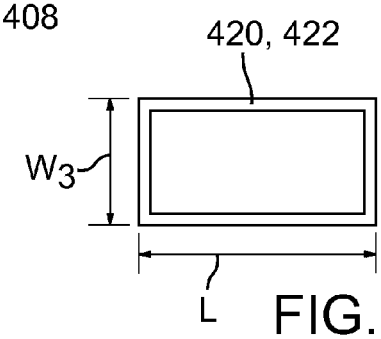
FIG. 22 is a top plan view of a vertical reinforcing member of the block shown in FIG. 20.

The vertical reinforcement members desirably are made of a suitable metal, such as steel, although any suitable materials useful for reinforcing concrete can be used. In particular embodiments, the reinforcement members comprises square or rectangular tubing (as shown in FIG. 22), although other types of elongated reinforcing members can be used, such as a length of pipe, a solid rod, or a length of channel having any of various cross-sections. An advantage of using a tubular, or hollow, member is that a post-tensioned member (e.g., an elongated cable or rod) can be inserted vertically through vertically aligned reinforcement members 420 of multiple blocks stacked on top of each other. The upper and lower ends of the post-tensioned member can be secured with plates at locations below the lowermost course and above the uppermost course and placed in tension so as exert a compressive force to the blocks between the ends of the post-tensioned member. In a specific embodiment, the vertical reinforcement members 420, 422 comprise tubing having a rectangular cross-section (as depicted in FIG. 22) having a length L of about 1.5 inches and a width $W_3$ of about 1.0 inch, although these dimensions can vary. Each of the vertical reinforcement members desirably is positioned such that the length L of the cross-section is parallel to the front surface 406 of the block.

As best shown in FIG. 21, the vertical reinforcement members 420, 422 can be placed on the "quarter points" of the block, which are locations spaced from respective side surfaces 410 a distance equal to one-quarter the width of the block (the total distance between side surfaces 410).

The block 400 can also include a first set of horizontally disposed reinforcement members 432 and a second set of horizontally disposed reinforcement members 434. The horizontal reinforcement members 432, 434 can be conventional steel rebar or any other suitable reinforcement members useful for reinforcing concrete. As best shown in FIG. 21, reinforcement members 432 extend in the direction of the width of the block. As best shown in FIG. 20, reinforcement members 434 extend in the direction of the depth of the block.

The block 400 can be formed by placing the vertical and horizontal reinforcement members 420, 422, 432, 434 in a mold having a mold cavity sized and shaped to form the block in a wet-cast process. The forward vertical reinforcement members 420 can be supported on top of a portion of the mold that forms the channel 412 of the block. The horizontal reinforcement members 432, 434 can be supported by the vertical reinforcement members 420, such as with conventional rebar ties or by inserting reinforcement members 432, 434 through corresponding openings in the vertical reinforcement members 420. The rear vertical reinforcement members 422 can be supported on respective horizontal reinforcement members 434, such as with conventional rebar ties or by inserting respective reinforcement members 434 through corresponding openings in the vertical reinforcement members 422. After the reinforcement members are in place, concrete can be poured into the mold and allowed to cure, after which the hardened, cured block can be removed from the mold.

The upper portions 424, 426 of the vertical reinforcement members can serve as attachment locations for lifting elements for lifting the block. For example, a bolt 436 can be secured to each adjacent pair of vertical reinforcement members 420, 422, such as by welding the bolt 436 to the upper portions 424, 426, or by inserting the bolt 436 through corresponding openings in the upper portions 424, 426 and securing the ends of the bolt with nuts 438 as depicted in FIG. 20. The block 400 can be lifted and relocated by securing a lifting device (e.g., a chain with a hook or lifting straps) to each of the bolts 436 and to a vehicle or machine (e.g., such as the tines of a forklift or backhoe) that is capable of lifting the weight of the block. In this manner, the block can be easily lifted and relocated, such as when positioning the block for shipment or positioning the block within a course of a wall during construction of the wall.

Figure 23:
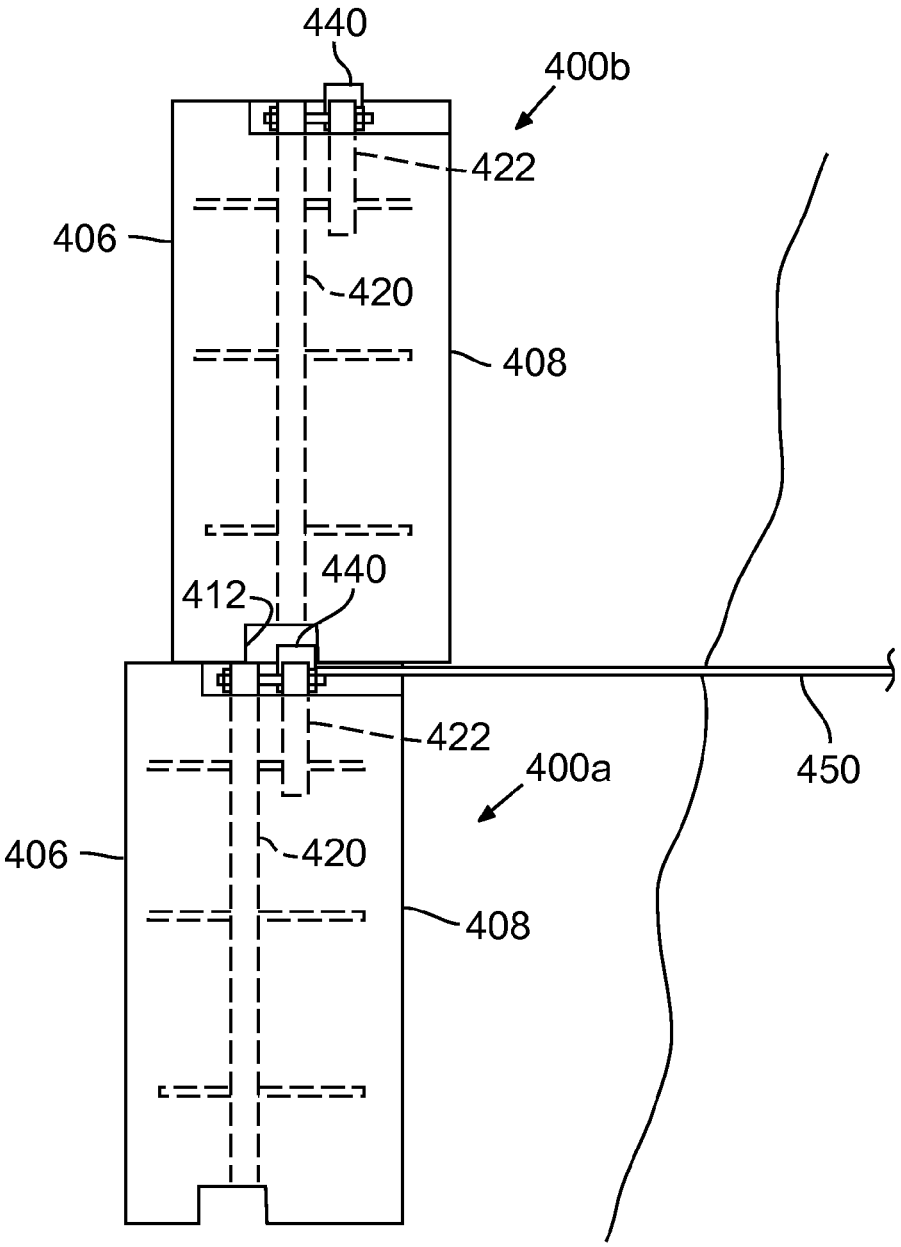
FIG. 23 is a side view illustrating the construction of a wall made from blocks of the type shown in FIG. 20.

The upper portions 424, 426 of the vertical reinforcement members can also be used as part of a block alignment and connection system for aligning and interconnecting vertically adjacent blocks. In the illustrated embodiment, for example, the upper portions 424, 426 are configured to receive a block-connecting element 440 in the form of a cap that fits on top of the upper portions 424, 426 of the vertical reinforcement members. The block-connecting element 440 is sized such that when placed on the upper portion of a vertical reinforcement member it can extend upwardly into a channel 412 in an overlying block. FIG. 23, for example, shows the construction of a wall having a positive batter in which a block 400*a* in a first course is connected to a block 400*b* in a second course in a set back position relative to the lower block 400*a*. In this case, a connecting element 440 is placed on a rear vertical reinforcement member 422 of the lower block 400*a* and extends upwardly into the channel 412 of the upper block 400*b*. It should be noted that a block connecting element 400 can be placed on each available reinforcement member 422. In order to form a vertical wall without a batter, one or more connecting elements 440 are placed on respective forward vertical reinforcement members 420 of the lower block 400*a* such that when the channel 412 of upper block 400*b* is aligned over the connecting element, the two blocks are vertically aligned.

Figure 23A:
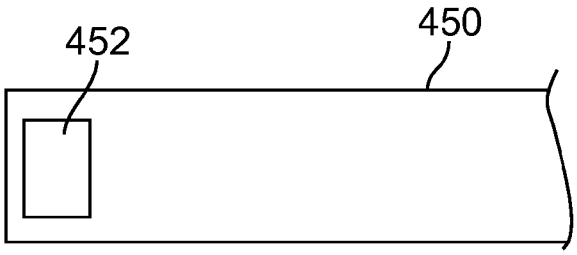
FIG. 23A is a top plan view of a soil reinforcing strap shown in FIG. 23.

As further shown in FIG. 23, the vertical reinforcement members 420, 422 can be used as an anchor for securing a soil reinforcing strap 450 to the block 400. The soil reinforcing strap 450 extends into the soil behind the wall to reinforce that course of the wall, much like the tie-back sheet 56 described above. As shown in FIG. 23A, the soil reinforcing strap 450 can have an opening 452 that is sized to fit over the upper end portion of a vertical reinforcement member 420, 422. The opening 452 can be also be large enough to fit over a connecting element 440 placed on a vertical reinforcement member. Alternatively, instead of an opening 452, the forward end of the strap 450 can have a fitting or connection that fits on or connects to a vertical reinforcement member. The soil reinforcing strap 450 can be made of any of various suitable materials, such as natural or synthetic elastomers (e.g., rubber), metal (e.g., thin sheets or straps of aluminum or galvanized steel) and/or polymeric materials (e.g., synthetic fabric material or sheets of polymeric material). If non-metallic materials are used, the opening 452 can be reinforced with a metal grommet.

The block 400 in the illustrated embodiment is shown without any dovetail connections for connecting one or more trunk blocks 14 to the rear surface 408. In alternative embodiments, the rear of block 400 can be formed with one or more dovetail connections, such as one or more female dovetail connections 22, configured to engage one or more trunk blocks as described above.

Figure 24:
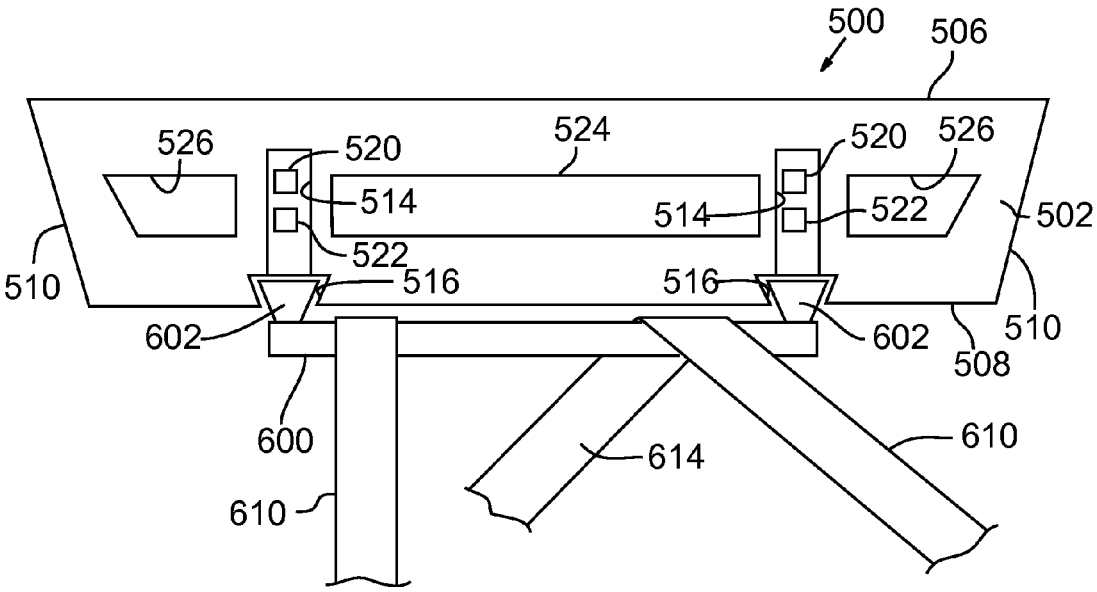
FIG. 24 is a top plan view of a wet-cast concrete block, according to another embodiment, having a mechanism for coupling soil reinforcing straps to the block.
Figure 25:
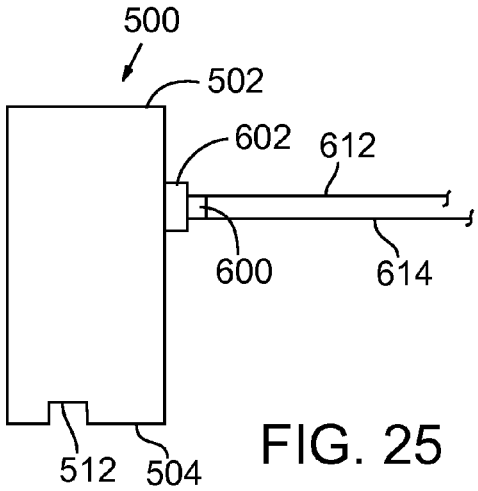
FIG. 25 is a side elevation view of the block shown in FIG. 24.

FIGS. 24-25 show a block 500, according to another embodiment, which desirably comprises a wet-cast block. The illustrated block 500 has an overall configuration similar to face block 12 described above. The block 500 can have overall dimensions that are the same as those described above for face block 12. The block 500 comprises upper and lower surfaces 502 and 504, respectively, opposed front and rear surfaces 506 and 508, respectively, and opposed side surfaces 510 extending from respective ends of the front surface to respective ends of the rear surface. The lower surface 504 can be formed with a channel 512 that desirably extends the entire width of the block (the width being measured from one side surface to the other). The upper surface 502 can be formed with one or more recessed portions or pockets 514 (two in the illustrated embodiment) spaced apart from each other in the direction of the width of the block.

As further shown in FIG. 24, the block 500 can include vertical reinforcement members 520, 522, which can have the same construction and function as the vertical reinforcement members 420, 422 of block 400 described above. The upper end portions of the reinforcement members 520, 522 extend into recesses 514 and are adapted to receive a block-connecting element 440 for connecting vertical adjacent blocks, as described in detail above. The block 500 can also be formed with one or more cores, such as a central core 524 positioned between the pairs of reinforcement members and two side cores 526. The cores 524, 526 can extend the entire height of the block.

The rear surface 508 of the block can be formed with spaced apart female dovetail grooves 516 that extend partially or the entire height of the block. The grooves 516 can be used to mount a coupling mechanism for coupling one or more soil reinforcing straps to the block. In the embodiment of FIGS. 24-25, the coupling mechanism comprises a support bar 600 mounted on the rear surface 508 of the block. The support bar 600 can in turn be used to support reinforcing straps that extend rearwardly into the soil behind the block, as further described below. The support bar 600 can have male dovetail elements 602 mounted at its opposite ends. The male dovetail elements 602 are sized and shaped to be received in the female grooves 516.

During construction of a wall, the support bar 600 can be positioned at a desired location along the height of the block by inserting the dovetail elements 602 in the grooves 516 and resting the dovetail elements 602 on soil that is backfilled behind the block to the desired height of the dovetail elements. The course formed from multiple blocks 500 can be reinforced in the horizontal direction by wrapping one or more soil reinforcing straps 610 around the support bar 600 and extending the straps 610 over the soil behind the wall. Additional soil is then backfilled over the straps 610 to hold them in place.

As best shown in FIG. 25, each strap 610 extends around the support bar 600 and has an upper layer 612 and a lower layer 614 that extend rearwardly into the soil behind the wall. The rear ends (not shown) of the layers 612, 614 can extend the same or different distances into the soil. Also, the layers 612, 614 can be arranged to extend at a 90-degree angle relative to the rear surface 508 of the block (like the strap 610 on the left in FIG. 24). Alternatively, the upper and lower layers 612, 614 can be arranged to extend in different directions as they extend away from the rear surface 508 of the block. For example, the strap 610 on the right in FIG. 24 has upper and lower layers 612, 614 extending in diverging directions as they extend away from the rear surface 508 of the block at about 45-degree angles relative to the rear surface 508.

The soil reinforcing straps 610 can be conventional soil reinforcing straps and can be made of any of various suitable materials, such as natural or synthetic elastomers (e.g., rubber), metal (e.g., thin sheets or straps of aluminum or galvanized steel) and/or polymeric materials (e.g., synthetic fabric material or sheets of polymeric material). The support bar 600 and dovetail elements 602 can be made of metal (e.g., galvanized steel), polymeric materials, concrete, and/or composite materials.

In an alternative embodiment, the support bar 600 need not be used and one or more soil reinforcing straps 610 can be secured to the block by inserting the straps 610 through one or more of the cores 524, 526 of the block.

Figure 26:
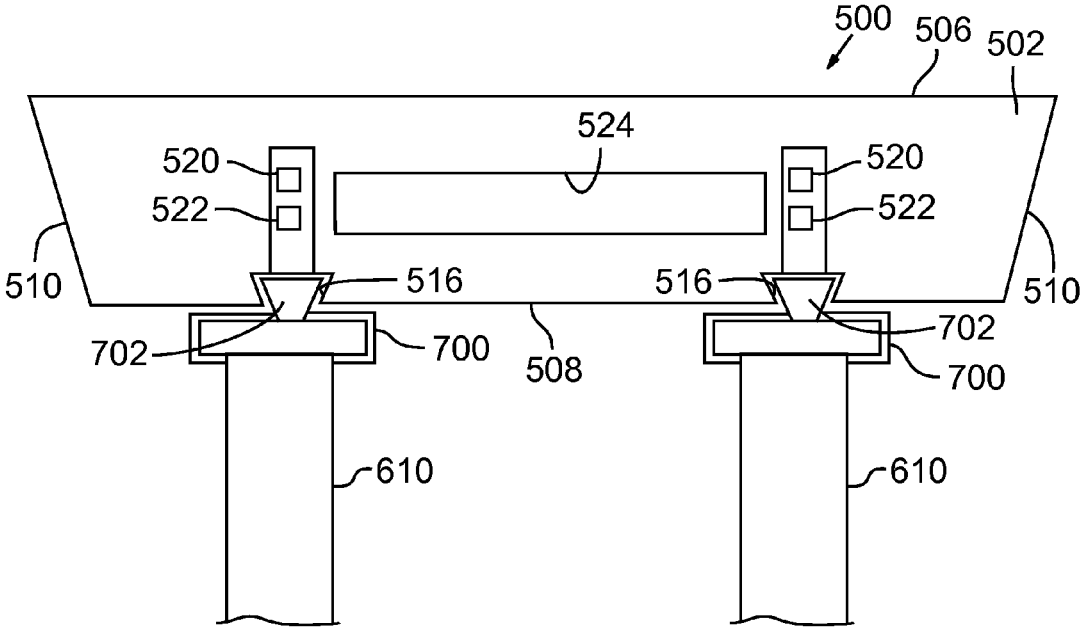
FIG. 26 is a top plan view similar to FIG. 24 showing an alternative mechanism for coupling soil reinforcing straps to the block.
Figure 27:
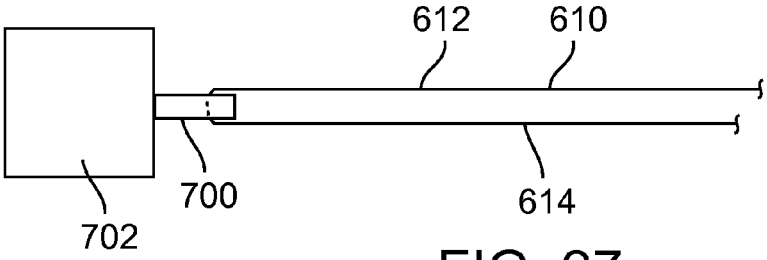
FIG. 27 is a side view of the coupling mechanism and the soil reinforcing strap shown in FIG. 26.
Figure 28:
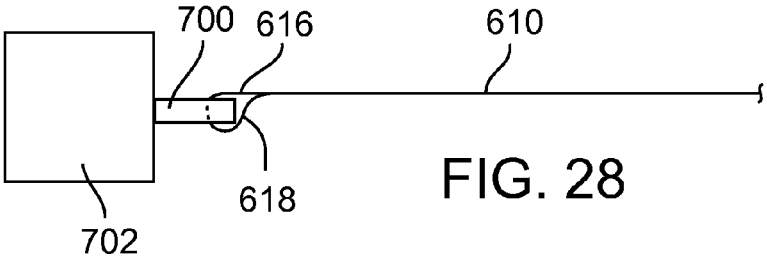
FIG. 28 is a side view of the coupling mechanism of FIG. 26, showing an alternative way of securing a soil reinforcing strap to the coupling mechanism.
Figure 29:
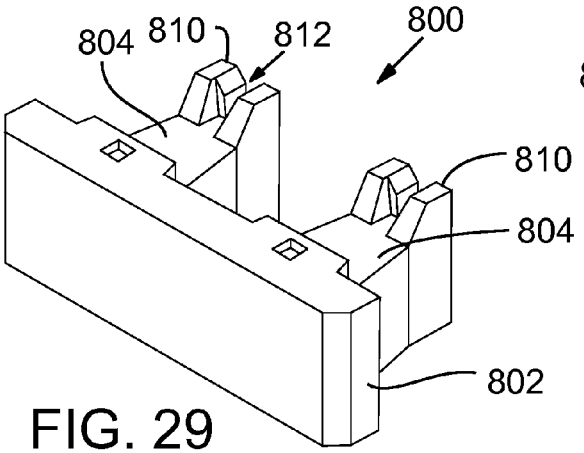
FIGS. 29-32 are various views of a face block, according to one embodiment.
Figure 32:
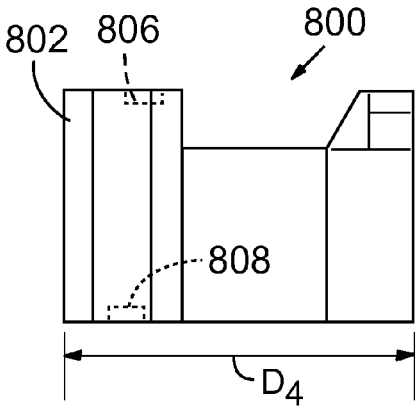

FIG. 26 shows an alternative use of the block 500. In the embodiment of FIG. 26, each soil reinforcing strap 610 extends around a separate support ring 700. Each support ring 700 includes an end portion 702 (which comprises a dovetail element in FIG. 26) that is received within a groove 516 in the rear surface 508 of the block. As shown in FIG. 27, a soil reinforcing strap 610 can be arranged to extend through the ring 700 and can have upper and lower layers 612, 614 that extend rearwardly into the soil behind the wall a desired distance. In another implementation, as shown in FIG. 28, a soil reinforcing strap 610 can have a layer 616 that forms a loop 618 at its forward end that extends through the ring 700 and is folded back and secured to itself, such as with an adhesive, stitching, welding, mechanical fasteners, depending on the material used to fabricate the strap.

In alternative embodiments, a coupling mechanism for a soil reinforcing strap can be permanently secured to a block, such as block 500. For example, the support bar 600 or support ring(s) 700 can be permanently mounted to the block 500 during the molding process. In this embodiment, it would not be necessary to form the grooves 516. Instead, the end portions 602 of the bar 600 (which do not need to have a dovetail shape in this case) can be partially embedded in the concrete block to permanently secure the bar in place. Similarly, the end portion 702 of the ring 700 (which does not need to have a dovetail shape in this case) can be partially embedded in the concrete block to permanently secure the bar in place.

In alternative embodiments, blocks 500 can be used in combination with trunk blocks 14 and anchor blocks 16 to form larger block assemblies, which in turn are used to form the courses of a wall. In such embodiments, support devices for soil reinforcing straps 610, such as a support bar 600 or support rings 700, can be mounted to the grooves 22 of the anchor blocks 16 when soil reinforcing straps are needed to reinforce a course of block assemblies.

FIGS. 29-32 show various views of a face block 800, according to another embodiment, which can be either a wet-cast or a dry-cast face block. The block 800 in the illustrated embodiment comprises a face portion 802 and two leg portions 804 formed integrally with and extending rearwardly from the face portion 802. The face portion 802 in the illustrated embodiment includes a front surface 820, two side surfaces 822, a rear surface 824, a top surface 828, and a bottom surface 830. The face portion 802 has a width $W_4$ extending between the two side surfaces 822, a depth $D_5$ extending between the front surface 820 and the rear surface 824, and a height $H_4$ extending between the top surface 828 and the bottom surface 830. Also in the illustrated embodiment, beveled corners 826 link the front surface 820 to each of the side surfaces 822.

As shown, the face portion 802 can also include two protrusions 832 extending rearwardly from the rear surface 824 of the face portion 802. The protrusions 832 in the illustrated embodiment extend rearwardly from the quarter points of the face portion 802 (i.e., at locations along the width of the face portion 802 that are spaced inwardly from the side surfaces 822 a distance equal to about ¼ the width of the face portion 802), but in alternative embodiments need not extend from these locations. For example, in some alternative embodiments, the protrusions 832 extend rearwardly from points on the rear surface 824 closer to or farther from the side surfaces 822 than the quarter points of the face portion 802. Additionally, in some alternative embodiments, the protrusions 832 need not be spaced apart from the side surfaces 822 by the same distance.

The top surface 828 of the face portion 802 can be formed with two recesses or pockets 806, and the bottom surface 830 of the face portion 802 can be formed with two recesses or pockets 808. In the illustrated embodiment, the pockets 806, 808 are aligned with the quarter points of the top surface 828 and the bottom surface 830, respectively, and thus are also aligned with the protrusions 832. In alternative embodiments, the pockets 806, 808 need not be so aligned. For example, the pockets 806, 808 in alternative embodiments can be located closer to or farther from the side surfaces 822 than the quarter points of the face portion 802. Further, the pockets 806, 808 need not be aligned with the protrusions 832, and need not be spaced apart from the side surfaces 822 by the same distance. As described in further detail below, aligning the pockets 806 with the pockets 808 vertically (i.e., so that at least a portion of the pockets 806 overlay at least a portion of the pockets 808 when the face portion 802 is viewed from a top plan view) facilitates stacking of multiple blocks 800 in a plurality of courses of blocks 800. The pockets 806, 808 can be sized to receive alignment devices (e.g., block connecting elements 100 or alignment plugs 1500, which are described in greater detail below) for interconnecting (when stacking) multiple blocks 800 in adjacent courses of blocks 800, in a manner similar to that described above with regard to courses of block assemblies 10.

Each leg portion 804 can include a front end portion 834 formed integrally with and extending rearwardly from a respective protrusion 832, and a rear end portion 810 formed integrally with and extending rearwardly from the front end portion 834. The front end portion 834 can have a height which is less than the height $H_4$ of the face portion 802. Each protrusion 832 and respective front end portion 834 can together have an overall generally tapered shape having a width which decreases linearly from a maximum width at the rear surface 824 of the face portion 802 to a minimum width where the front end portion 834 is joined to its respective rear end portion 810. Thus, the front end portion 834 of each leg portion 804 can couple each rear end portion 810 to a respective protrusion 832 while separating the rear end portion 810 from the respective protrusion 832 by a desired distance.

Figure 30:
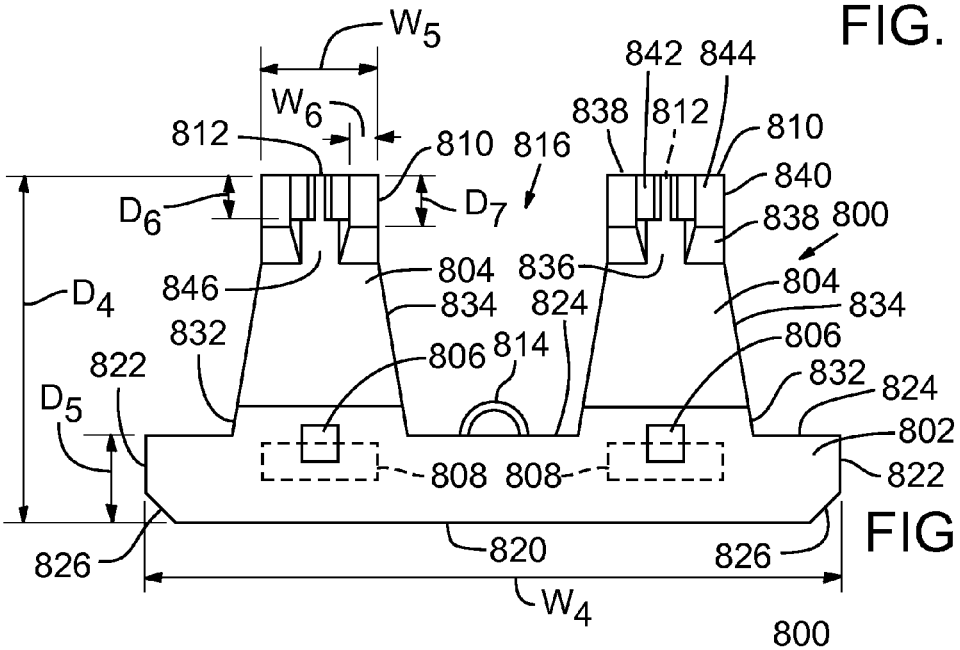
Figure 31:
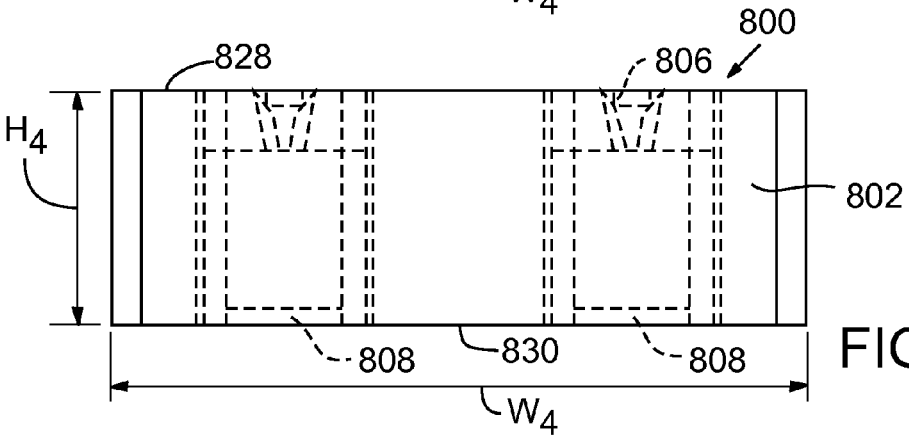
Figure 33:
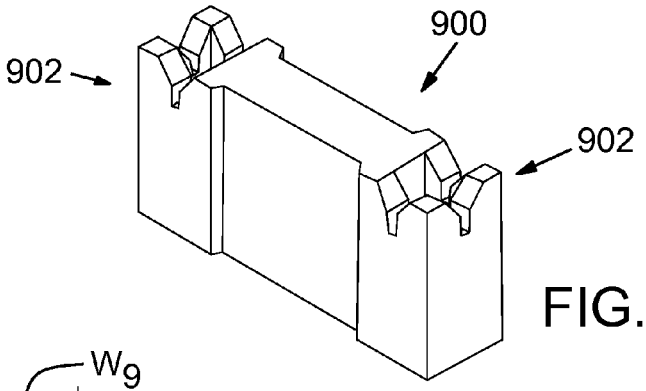
FIGS. 33-36 are various views of a trunk block, according to one embodiment.
Figure 34:
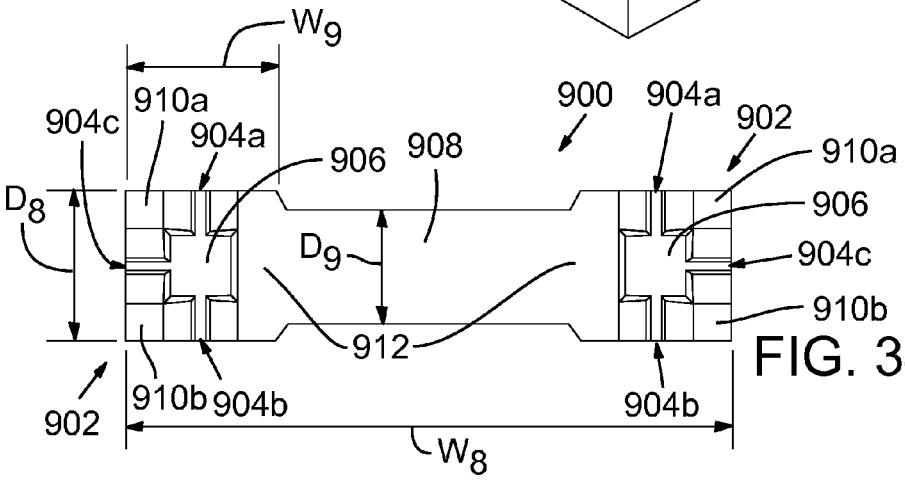
Figures 35, 36:
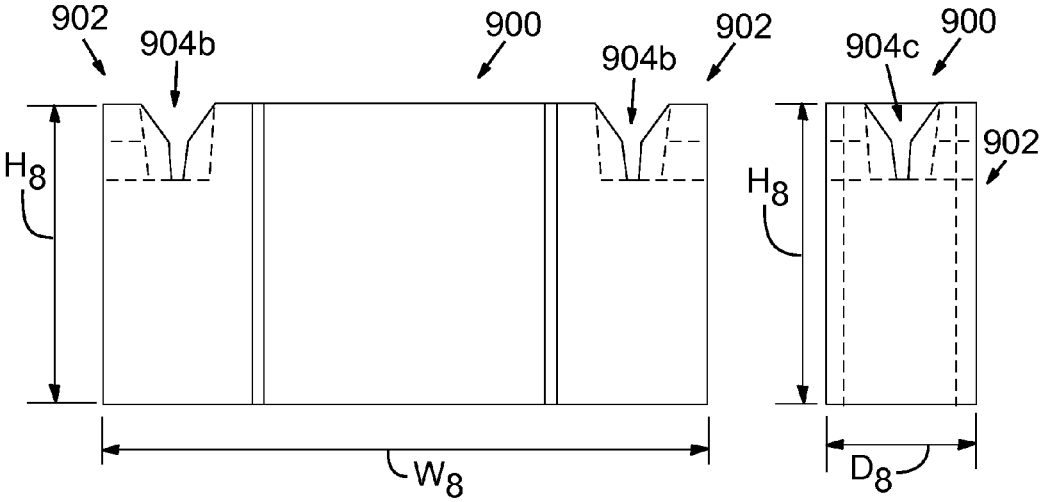

Each rear end portion 810 can include a pair of ridges 838 having a slot 812 between them. The slot 812 can be configured to receive a connecting member that couples the block 800 to another block placed at the rear of the leg portions, as further described below. For example, as shown in FIGS. 29-32, each rear end portion 810 can have an upper surface 836 from which the two ridges 838 extend. In the illustrated embodiment, the upper surface 836 is formed so as to be flush with a top surface of the front end portion 834 and the ridges 838 are formed so that they do not extend above the top surface 828 of the face portion 802. The ridges 838 can be formed in any of various suitable configurations, such that the slot 812 is defined between them. As best shown in FIG. 30, each ridge can comprise a truncated pyramid 840 which tapers from a relatively large rectangular base at the upper surface 836 to a relatively small top surface 844. Each ridge 838 can also comprise a gambrel portion 842 which extends outward from the rearmost portion of the truncated pyramid 840 toward the other ridge 838 of the rear end portion 810. In this configuration, a tapered slot 812 is defined between the two ridges 838 and in particular between the two gambrel portions 842 of the rear end portion 810. Additionally, a pocket 846 is created between the truncated pyramids 840 forward of the gambrel portions 842, which can be occupied by an end portion (e.g., a flange) of a connecting member, as further described below.

The block 800 can be formed with any of various desired textures and/or configurations that enhance the appearance of the block 800, for example on the front surface 820 of the face portion 802. For example, the front surface 820 can be provided with any of the textures, patterns, designs, or configurations described above with regard to face block 12. As shown in FIG. 30, a lifting ring 814 can be cast into the rear surface 824 of the face portion 802 to facilitate lifting and placement of the block 800, such as with a backhoe or other suitable equipment.

In particular embodiments, the block 800 is a wet-cast block has a weight of less than 1,500 lbs., more desirably less 1,000 lbs., and even more desirably less than 800 lbs.; a front face area of at least 4.0 sq. feet, and more desirably at least sq. 5.0 feet, and even more desirably at least sq. 5.33 feet; and a face area ratio of less than 2.0 feet, more desirably less 1.5 feet, and even more desirably less than 1.0 foot. The "face area ratio" of a block is defined as the ratio of the volume of concrete needed to form the block divided by the face area of the block.

In one specific implementation, the block 800 can have an overall width $W_4$ of about 48 inches, an overall depth $D_4$ of about 24 inches, and an overall height $H_4$ of about 16 inches. The face portion 802 can have a depth $D_5$ of about 6 inches, the protrusions can have a depth of about 2 inches, the leg portions 804 can have a depth of about 16 inches, the rear end portions 810 can have a width $W_5$ of about 8 inches, the top surface 844 of the truncated pyramid 840 can have a width $W_6$ of about 2 inches and a depth $D_7$ of about 3.5 inches, and the gambrel portion 842 can have a depth $D_6$ of about 3 inches. In such an implementation, the block 800 is a wet-cast block having a weight of about 746 lbs., a front face area of 5.33 sq. feet (48 inches×16 inches), a volume of about 5.15 cubic feet, and a face area ratio of about 0.966.

Multiple blocks 800 of this size can be used to form a wall up to about 5 feet in height without additional earth retention mechanisms (such as geogrid) and without additional blocks that extend the depth of each course. The depth of the void 816 defined between the two leg portions 804 in the illustrated embodiment is about 18 inches. During construction of a wall, the voids 816 of each block in a course and each void between adjacent blocks 800 can be backfilled with gravel. Most building codes require at least 12 inches of gravel behind each course of a wall for sufficient drainage. Thus, backfilling the voids 816 and the voids between adjacent blocks with gravel can satisfy the backfill requirement without additional gravel placed behind the rear of the blocks (i.e., behind the leg portions 804).

FIGS. 33-36 show various views of a trunk block 900 that can be used in combination with the block 800 in various configurations to increase the strength or other desirable characteristics of a course of blocks. The trunk block 900 can be either a wet-cast or a dry-cast trunk block. The trunk block 900 can have opposite end portions 902 and an intermediate portion 908 which interconnects the two end portions 902. The intermediate portion 908 can have a depth which is less than a depth of the end portions 902, a height which approximates the height $H_4$ of the face block 800, and a length which serves to separate the end portions 902 by about the same distance as that which separates the rear end portions 810 of the leg portions 804 of the block 800.

Each of the end portions 902 can be formed with one or more slots 904*a*, 904*b*, 904*c* (three in the illustrated embodiment) in the upper surface of the end portion 902 and can have a recess or pocket 906 formed between and which interconnects the slots 904*a*, 904*b*, 904*c* in the upper surface of the end portion 902. Each end portion 902 can comprise a wall 912 formed integrally with the intermediate portion 908 and two upwardly extending protrusions 910*a*, 910*b*, between which is formed the slot 904*c*. The protrusions 910*a*, 910*b* can be positioned such that slot 904*a* is defined between wall 912 and protrusion 910*a* and such that slot 904*b* is defined between wall 912 and protrusion 910*b*. As shown, the protrusions 910*a*, 910*b* and the wall 912 can each include two gambrel-shaped portions resembling the gambrel portions 842 of block 800, such that each of the slots 904*a*, 904*b*, 904*c* have a width which tapers from a maximum width at the top of the block 900 to a minimum width at the bottom of the slot.

In one specific implementation, the block 900 can have an overall width $W_8$ of about 32 inches, an overall depth $D_8$ of about 8 inches, and an overall height $H_8$ of about 16 inches. Each end portion 902 can have a width $W_9$ of about 8 inches and a depth $D_8$ of about 8 inches, and the intermediate portion 908 can have a depth $D_9$ of about 6 inches. In such a configuration, the block 900 is a wet-cast block and can have a weight of about 286 lbs.

FIGS. 37-40 show various views of a block assembly formed with one block 800 and a block 900 placed in a perpendicular relationship with respect to the leg portions 804 of the block 800. As shown, the block 900 can be positioned such that the end portions 902 of the block 900 are placed against the rear end portions 810 of the block 800 and the slots 904*b* are aligned with slots 812 of the end portions 810. Connection devices (described below) can be placed in respective pairs of slots 812, 904*b* to interconnect the blocks 800, 900. The block 900 can serve as an anchor block and can extend the effective depth of the block 800 to permit construction of taller walls. The block assembly defines an enclosed space in a horizontal plane extending through the blocks 800, 900. In other words, the space defined by the blocks 800, 900 in the illustrated embodiment is enclosed on all sides expect at the top and bottom of the blocks. When forming courses of a wall from multiple block assemblies, backfill material, such as gravel, can be placed in the enclosed space.

Figure 41:
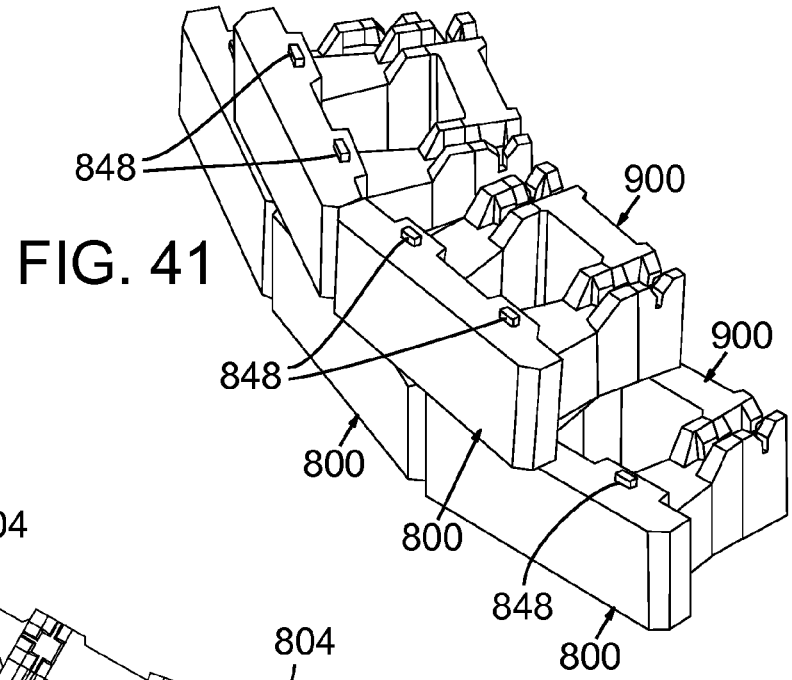
FIGS. 41-43 are various views of two courses of a curved retaining wall formed from multiple block assemblies of the type shown in FIGS. 37-40.
Figure 42:
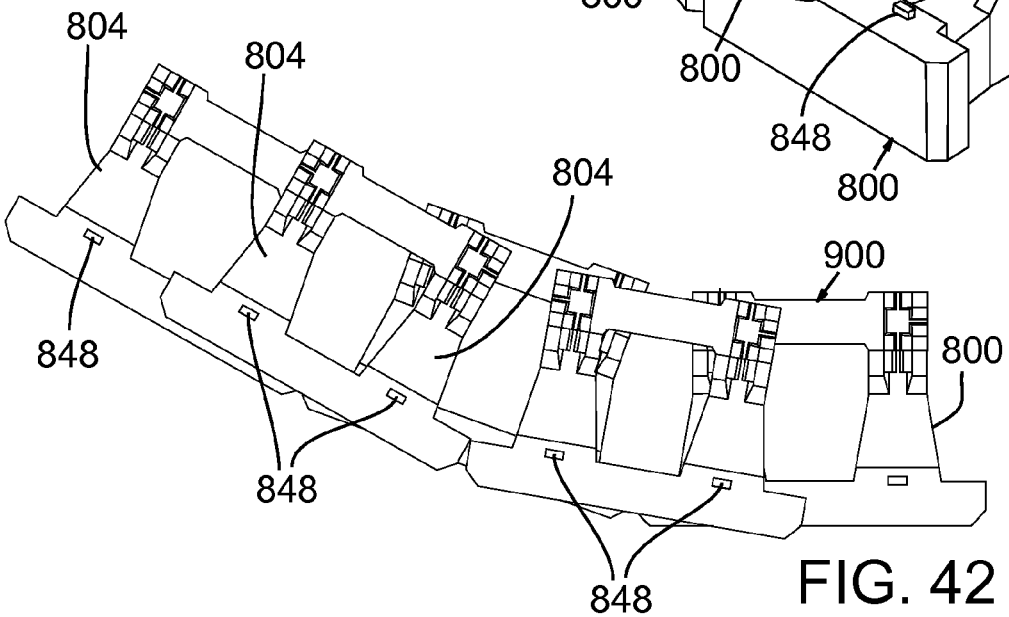
Figure 43:
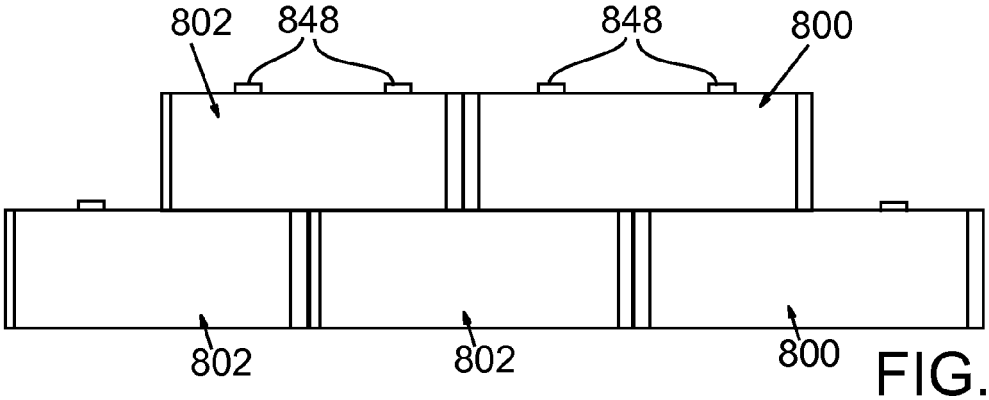
Figure 44:
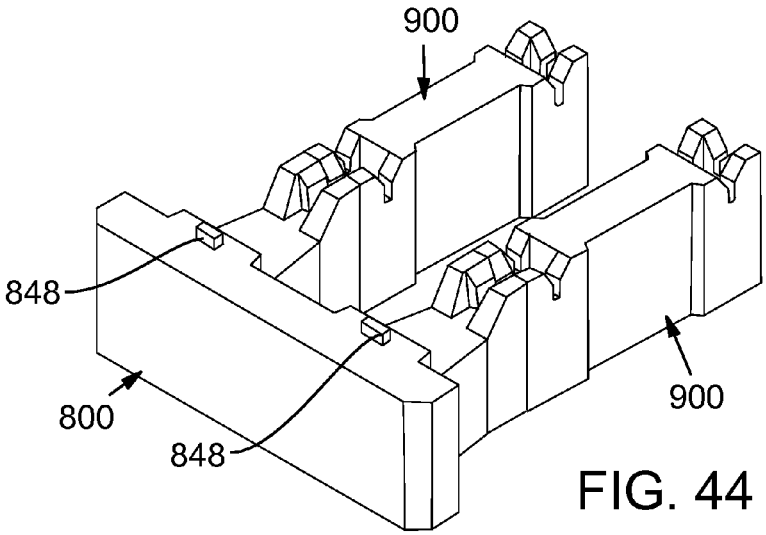
FIGS. 44-47 are various views of another embodiment of a block assembly comprising the face block of FIGS. 29-33 and two of the trunk block of FIGS. 33-36.

In one specific implementation, the block assembly shown in FIGS. 37-40 can have an overall width of about 48 inches, an overall depth of about 32 inches, and an overall height of about 16 inches. The ridges 838 and protrusions 910, and thus the slots 812, 904*a*, 904*b*, and 904*c* can have a height $H_9$ of about 4 inches. In the embodiment illustrated in FIGS. 37-40, the block 800 is formed integrally with protrusions or nubs 848 for interconnecting the block 800 with another block in an adjacent course of blocks, as illustrated in FIGS. 41-43. Multiple block assemblies of this size can be used to form a wall up to about 7 feet in height without additional earth retention mechanisms (such as geogrid).

Figure 37:
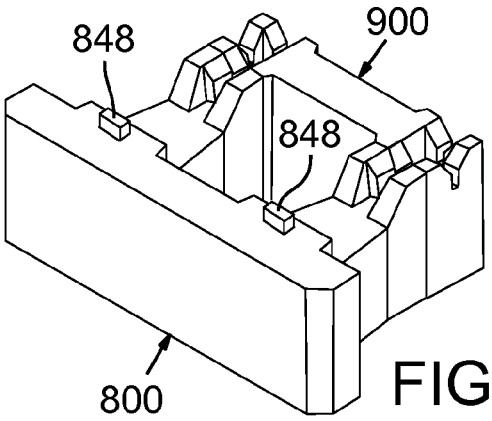
FIGS. 37-40 are various views of a block assembly comprising the face block of FIGS. 29-32 and the trunk block of FIGS. 33-36, according to one embodiment.
Figure 38:
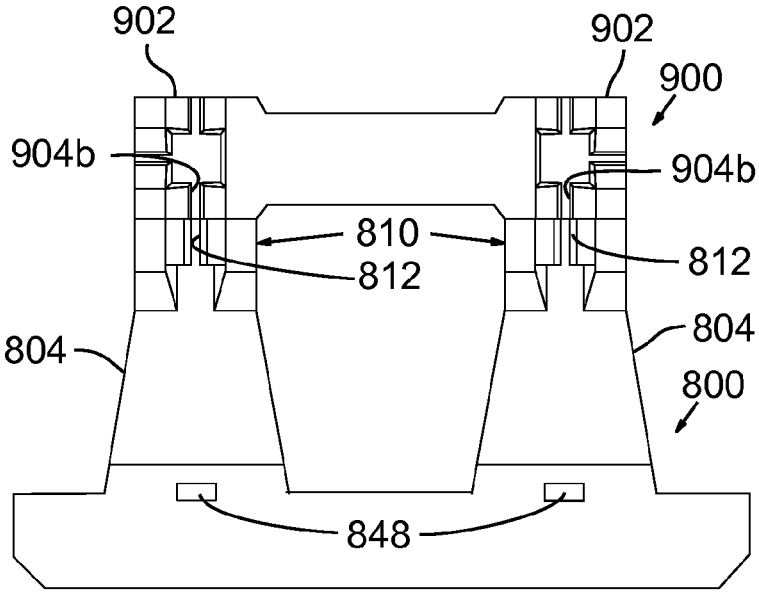
Figure 40:
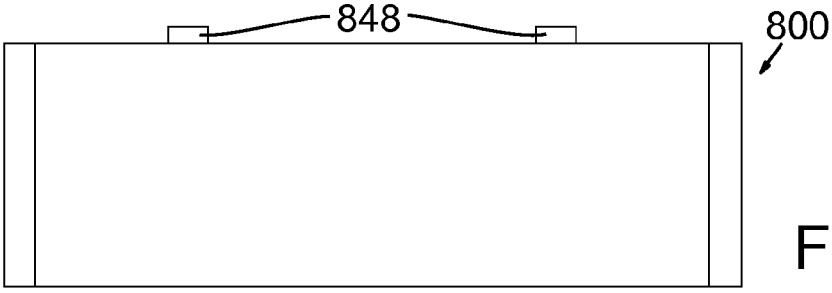
Figure 39:
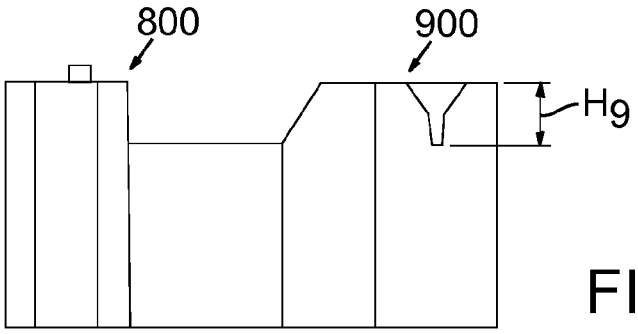

FIGS. 41-43 show various views of two partial courses of a curvilinear wall constructed from multiple block assemblies of the type shown in FIG. 37. The block assemblies of the upper course can be placed in a running bond pattern with respect to the block assemblies of the lower course. In this manner, the front portion 802 of each block 800 in the upper course can straddle the front portions 802 of two adjacent blocks 800 in the lower course. By virtue of the leg portions 804 being at the quarter points of the block, each leg portion 804 in the upper course can be vertically stacked on top of a leg portion 804 in the lower course.

FIGS. 44-47 show various views of a block assembly comprising one block 800 and two blocks 900, wherein each of the blocks 900 is placed end-to-end with a leg portion 804 of the block 800 to extend the effective depth of the block 800. The blocks 900 can be aligned with the leg portions 904 such that a slot 904*c* of each block 900 is aligned with a respective slot 812 of a leg portion 804. Connection devices (described below) can be placed in respective pairs of slots 812, 904*c* to interconnect the blocks. In the embodiment illustrated in FIGS. 44-47, the block 800 is formed integrally with protrusions or nubs 848 for interconnecting the block 800 with another block in an adjacent course of blocks.

In one specific implementation, the block assembly shown in FIGS. 44-47 can have an overall width of about 48 inches, an overall depth of about 56 inches, and an overall height of about 16 inches. Multiple block assemblies of this size can be used to form a wall up to about 12 feet in height without additional earth retention mechanisms (such as geogrid). In some applications, a 12-foot high wall can comprise three lower courses formed from multiple block assemblies of the type shown in FIGS. 44-47, two or more intermediate courses formed from multiple block assemblies of the type shown in FIGS. 37-40, and two or more courses formed from multiple blocks 800.

Integral protrusions 848, block-connecting elements 100 (FIGS. 11-16), or block connecting elements 1500 (FIGS. 57-60) can be used to interconnect blocks 800 in adjacent courses that are stacked vertically, with a positive batter, or with a negative batter, as described in connection with the block shown in FIG. 2. For example, when laying a new course on a previously laid course, the lower portion 1502 of a block-connecting element 1500 is placed within a pocket 806 in a block in the previously laid course and the upper portion 1504 is inserted into the pocket 808 of a block of the newly formed course.

Figure 48:
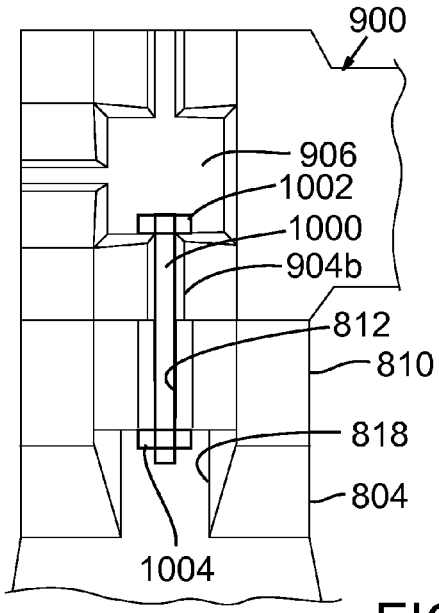
FIGS. 48-51 show different embodiments of a connecting element being used to connect a face block and a trunk block.

FIGS. 48-51 show various embodiments of connecting elements that can be used to interconnect one end portion 902 of a block 900 to a rear end portion 810 of a leg portion 804 of a block 800. FIG. 48 shows a connecting element in the form of a bolt or screw 1000 placed in a slot 812 of a rear end portion 810 of a leg portion 804 and a slot 904*b* of a block 900. A head portion 1002 of the bolt 1000 can be placed in the pocket 906 of the block 900 and a nut 1004 screwed onto the bolt 1000 can be placed in a pocket 818 of the rear end portion 810 so as to restrict separation of the blocks 800, 900 front to back (in the direction of the depth of the block assembly). In an alternative embodiment, the head portion 1002 can be positioned in the pocket 818 and the nut 1004 can be positioned in the pocket 906. In another alternative embodiment, the connecting element can be a threaded piece of rebar that has a nut threaded onto each end of the piece of rebar. In any case, the enlarged end portions of the connecting element are positioned to bear against adjacent surface portions of the pockets 818, 906 to resist separation of the blocks.

Figure 45:
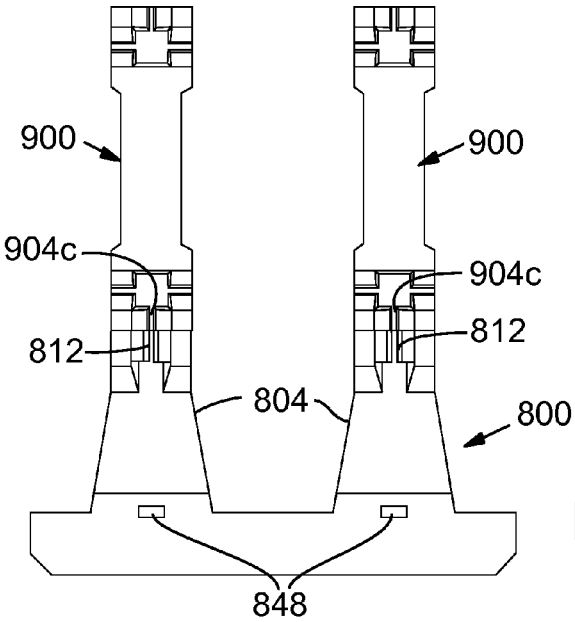
Figure 47:
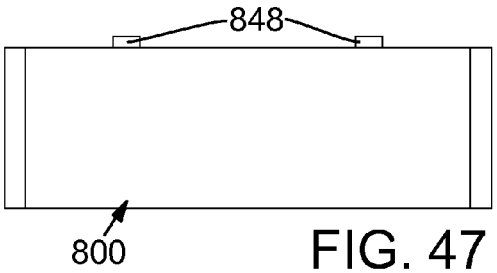
Figure 46:
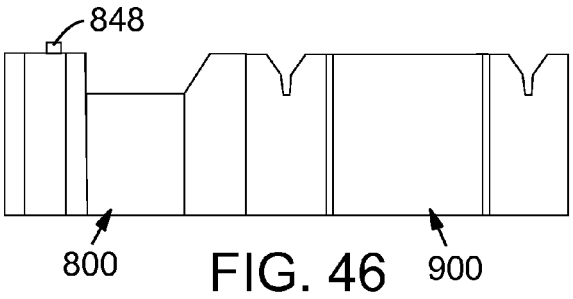
Figure 49:
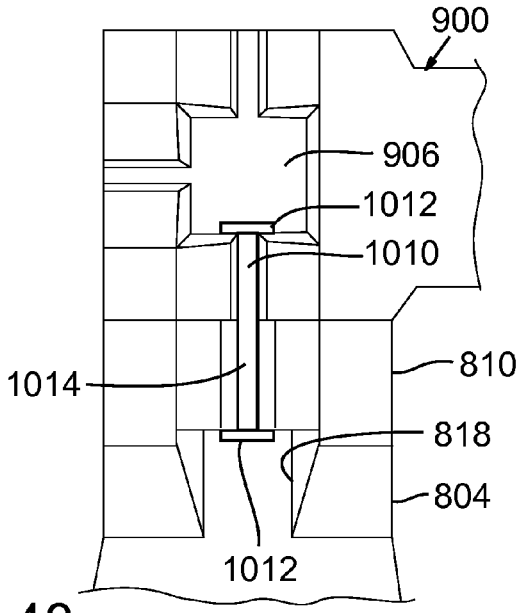
Figure 50:
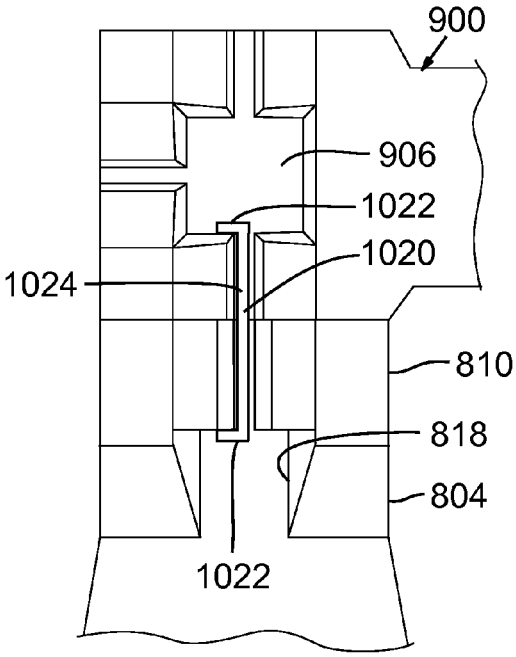
Figure 51:
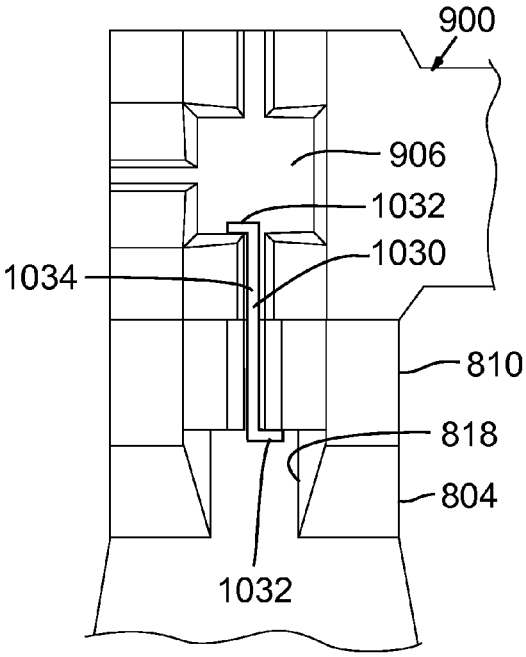

FIG. 49 shows a connecting element in the form of an I-shaped section of material 1010 having opposite end portions, or flanges, 1012 disposed in pockets 818, 906 and a web 1014 disposed within slots 812, 904*b*. Any of various suitable materials can be used to form the I-shaped section of material 1010, for example, any of various commercially available structural steel I-beams. FIG. 50 shows a connecting element in the form of a C-shaped section of material 1020 having opposite end portions, or flanges, 1022 disposed in pockets 818, 906 and a web 1024 disposed within slots 812, 904*b*. Any of various suitable materials can be used to form the C-shaped section of material 1020, for example, any of various commercially available structural steel channel sections. FIG. 51 shows a connecting element in the form of an S-shaped section of material 1030 having opposite end portions, or flanges, 1032 disposed in pockets 818, 906 and a web 1034 disposed within slots 812, 904*b*. The connecting elements 1010, 1020, 1030 can be made from any of various suitable materials, such as metals (e.g., stainless or galvanized steel, aluminum), polymers or composite materials, such as carbon-fiber- or fiberglass-reinforced steel. Although not illustrated, any of the connecting elements 1000, 1010, 1020, 1030 can be used in the same manner to interconnect a slot 904*c* of a block 900 with a slot 812 of a rear end portion 810 of a block 800 where a block 900 is placed end-to-end with a leg portion 804 of a block 800 as shown in FIG. 45.

Figure 52:
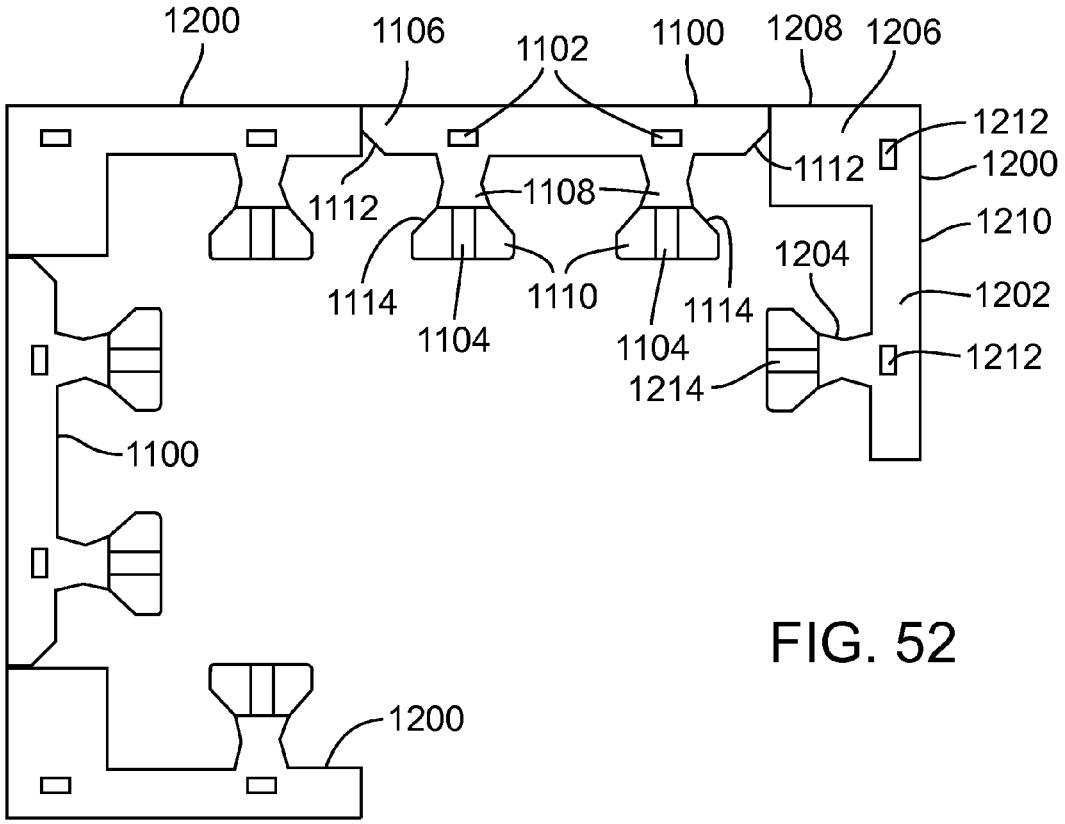
FIG. 52 shows a top plan view of a course of a wall comprising a plurality of blocks, according to one embodiment.

FIG. 52 is a top plan view of a course of a wall comprising blocks 1100 and corner blocks 1200. Blocks 1100 and the corner blocks 1200 can be either wet-cast or dry-cast blocks. The blocks 1100 have an overall configuration, size and weight similar to that of blocks 800 (FIGS. 29-32). A block 1100 can include a face portion 1106 having a pair of pockets 1102 formed in its upper surface and a corresponding pair of pockets (not shown) formed in its lower surface. The pockets formed in the upper and lower surfaces of the face portion 1106 can be configured to receive a block connecting element 100 (FIG. 11-16) or 1500 (FIGS. 57-60) for interconnecting multiple blocks 1100 in adjacent courses that are vertically stacked. The block 1100 can also include a pair of legs 1108 having respective rear end portions 1110 with slots 1104 formed therein. In the illustrated embodiment, the pockets 1102 are situated at the quarter points of the face portion 1106 and the legs 1108 are coupled to the face portion 1106 at the quarter points of the face portion 1106. In alternative embodiments, however, the pockets 1102 need not be situated at the quarter points of the face portion 1106 and the legs 1108 need not be coupled to the face portion 1106 at its quarter points.

In the illustrated embodiment, the face portion 1106 can have a generally rectangular configuration in plan view with two beveled corners 1112. Each rear end portion 1110 can have a generally rectangular configuration in plan view with two beveled corners 1114. Each leg 1108 can have a generally hourglass-shaped configuration and can couple a rear end portion 1110 to the face portion 1106 while separating the rear end portion 1110 from the face portion 1106 by a desired distance.

The overall configuration and size of corner blocks 1200 is illustrated in FIG. 52, where the corner blocks 1200 are illustrated adjacent to the blocks 1100, which have an overall configuration, size and weight similar to that of blocks 800. A corner block 1200 in the illustrated embodiment comprises a face portion 1202 which includes two pockets 1212 formed in its upper surface and a corresponding pair of pockets (not shown) formed in its lower surface. The pockets formed in the upper and lower surfaces of the face portion 1202 can be configured to receive a block connecting element 100 (FIG. 11-16) or 1500 (FIGS. 57-60) for interconnecting multiple blocks 1200 in adjacent courses that are vertically stacked.

The corner block 1200 can also include a leg portion 1204 which includes a slot 1214 and extends from a quarter point of the face portion 1202, and a corner piece 1206 at the end of the face portion 1202 farthest from the leg portion 1204. In the illustrated embodiment, the corner piece 1206 has a side surface 1208 that is perpendicular to the front face 1210 of the block 1200. Thus, when placed at the intersection of two wall sections, the corner block 1200 can form a 90-degree corner in the wall. In alternative embodiments, the leg portion 1204 need not be coupled to the face portion 1202 at its quarter point, the pockets 1212 can be situated in any of various suitable locations on the surface of the corner block 1200, and the angle formed between the side surface 1208 and the front face 1210 can be any of various suitable angles.

Figure 53:
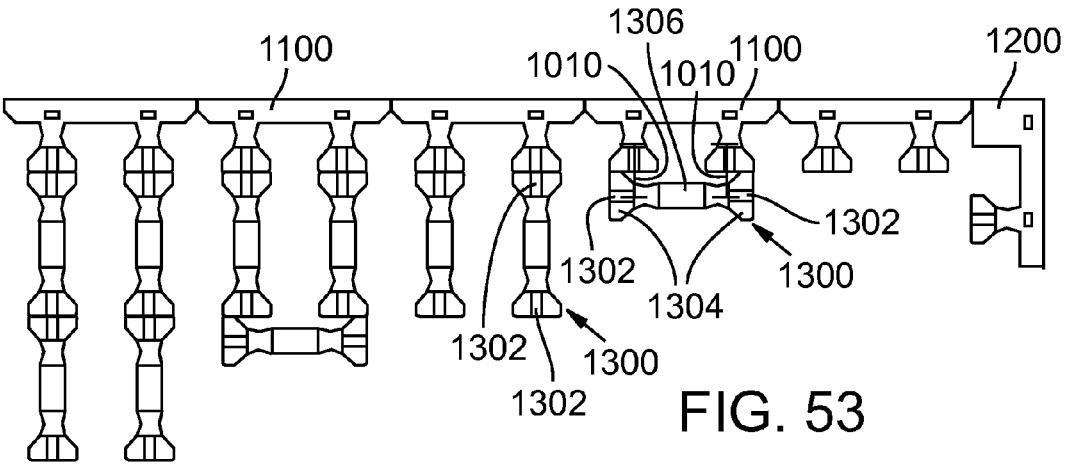
FIG. 53 shows a top plan view of a course of a wall comprising a plurality of blocks, according to another embodiment.

FIG. 53 is a top plan view of a course of a wall comprising blocks 1100, 1200, 1300, showing various possible positions of the blocks relative to each other. Blocks 1300 in the illustrated embodiment have an overall configuration, size and weight similar to that of blocks 900 (FIGS. 33-36). The blocks 1300 can be either wet-cast or dry-cast blocks. The blocks 1300 can each have two end portions 1304 having slots 1302 formed therein, and an intermediate portion 1306 which interconnects and separates the two end portions 1304. The blocks 800 and 900 can be placed in the same positions as blocks 1100 and 1300, respectively, and can be used with the corner blocks 1200 in the manner shown in FIG. 53. As shown, the slots 1104, 1214, and 1302 of the blocks 1100, 1200, and 1300, respectively, can be configured to receive a connecting element such as connecting element 1000, 1010, 1020, or 1030.

Figure 54:
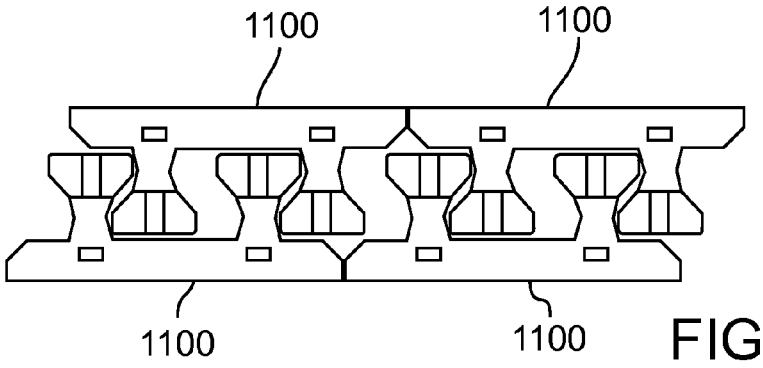
FIG. 54 shows a top plan view of a course of a wall comprising a plurality of blocks, according to another embodiment.
Figure 55:
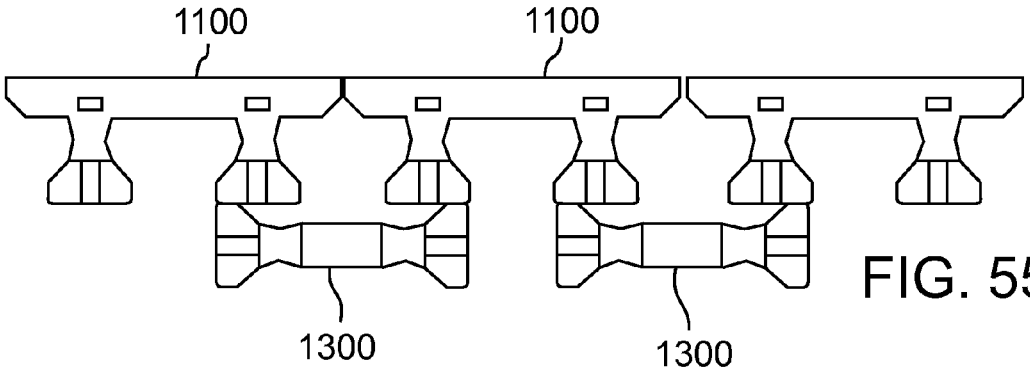
FIG. 55 shows a top plan view of a course of a wall comprising a plurality of blocks, according to another embodiment.

FIG. 54 is a top plan view showing multiple blocks 1100 placed back-to-back with the leg portions 1108 nested within each other to form a barrier wall or bench wall. Blocks 800 can be positioned in the same manner to form a barrier wall or bench wall. FIG. 55 is a top plan view showing multiple blocks 1100 and blocks 1300 being used to interconnect the leg portions 1108 of adjacent blocks 1100. Blocks 800 and 900 can be positioned in the same manner as blocks 1100 and 1300, respectively, as shown in FIG. 55.

Figure 56:
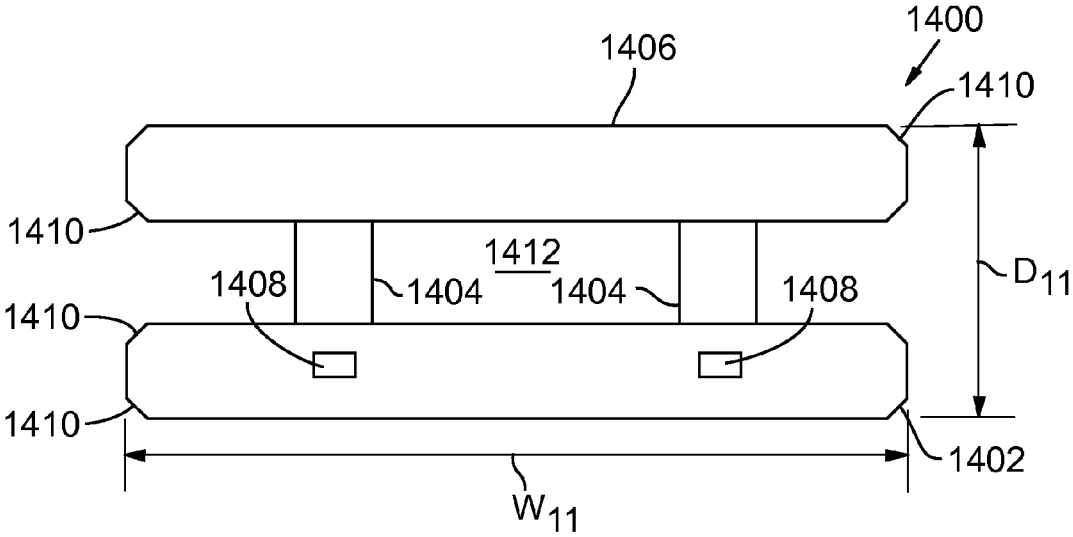
FIG. 56 shows a top plan view of a wall block, according to one embodiment.

FIG. 56 is a top plan view of another embodiment of a block 1400 comprising a face portion 1402, a rear portion 1406 that extends parallel to the face portion 1402, and two leg portions 1404 extending from the face portion to the rear portion 1406 and forming an enclosed space 1412 between them. The face portion 1402 and the rear portion 1406 can each include four beveled corners 1410. The leg portions 1404 in the illustrated embodiment extend rearwardly from the quarter points of the face portion 1402. A block 1400 in the illustrated embodiment comprises two pockets 1408 formed in the upper surface and at the quarter points of the face portion 1402 and a corresponding pair of pockets (not shown) formed in the lower surface of the face portion 1402. The pockets formed in the upper and lower surfaces of the face portion 1402 can be configured to receive a block connecting element 100 (FIG. 11-16) or 1500 (FIGS. 57-60) for interconnecting multiple blocks 1400 in adjacent courses that are vertically stacked. In a specific implementation, the block 1400 has an overall width $W_{11}$ of about 48 inches, an overall depth $D_{11}$ of about 18 inches, and a height of about 16 inches. In alternative embodiments, pockets can be formed in the upper and/or lower surfaces of the rear portion in addition to or instead of the pockets formed in the face portion 1402. In other alternative embodiments, the leg portions 1404 and the pockets 1408 can be situated at locations other than the quarter points of the face portion 1402 and the rear portion 1406.

Figure 57:
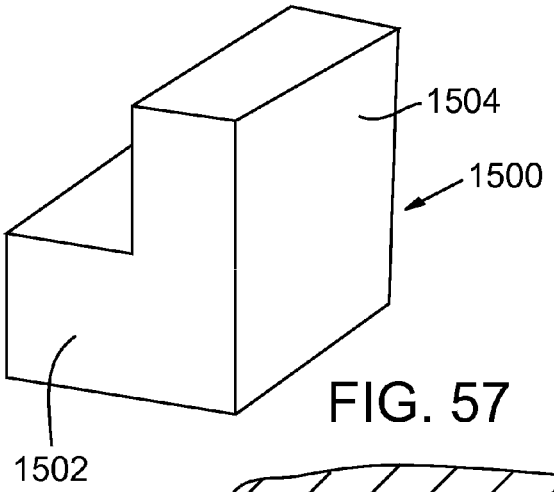
FIG. 57 shows a perspective view of a block alignment device, according to one embodiment.
Figure 58:
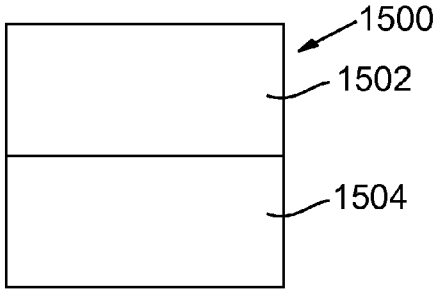
FIG. 58 shows a top plan view of the block alignment device of FIG. 57.

FIG. 57 shows a perspective view and FIG. 58 shows a top plan view of another embodiment of an alignment plug 1500 (also referred to as an alignment device or connection device) that can be used to interconnect multiple blocks 800, multiple blocks 1100, multiple blocks 1200, or multiple blocks 1400, stacked on top of each other in courses of a wall. The plug 1500 comprises a lower portion 1502 and an upper portion 1504. The lower portion 1502 is sized to be placed in a pocket 806 in the upper surface of a first block 800 (or a corresponding pocket in any of blocks 1100, 1200, or 1400) and the upper portion 1504 is sized to be placed in a pocket 808 in the lower surface of a second block 800 (or a corresponding pocket in any of blocks 1100, 1200, or 1400) stacked on top of the first block. In particular embodiments, the plug 1500 can be made of concrete, although other suitable materials, such as polymers, composites, or metals can be used to form the plug 1500.

Figure 59:
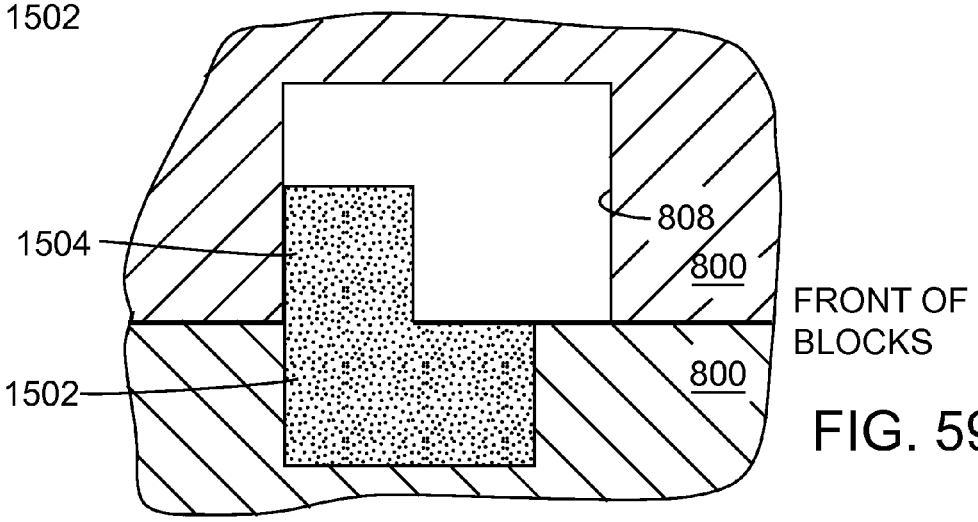
FIG. 59 shows the block alignment device of FIGS. 57-58 positioned so as to establish a positive batter between two blocks in adjacent courses.

FIG. 59 shows the placement of a plug 1500 in pockets 806, 808 to form a wall having a 4.5-degree setback (a positive batter). As shown, the lower portion 1502 of the plug 1500 is placed in a pocket 806 in the upper surface of a first, lower block 800 such that the upper portion 1504 is in a rearward position. The pocket 808 in the lower surface of a second, upper block 800 is placed over the upper portion 1504, which positions the second block in a setback relationship relative to the first block.

Figure 60:
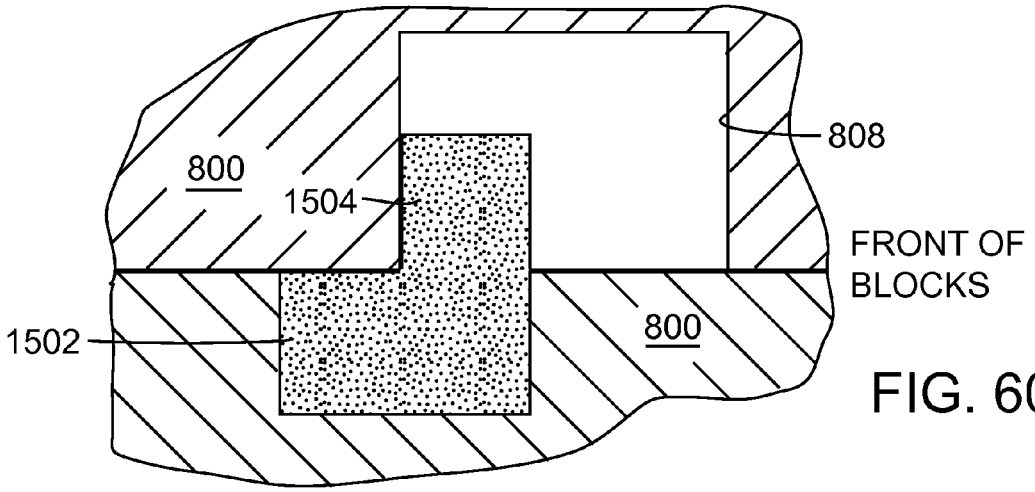
FIG. 60 shows the block alignment device of FIGS. 57-58 positioned to establish a vertical alignment between two blocks in adjacent courses.

FIG. 60 shows the placement of a plug 1500 in pockets 806, 808 to form a vertical wall. As shown, the lower portion 1502 of the plug 1500 is placed in a pocket 806 in the upper surface of a first, lower block 800 such that the upper portion 1504 is in a forward position. The pocket 808 in the lower surface of a second, upper block 800 is placed over the upper portion 1504, which aligns the second block vertically with respect to the first block.

Embodiments of wall blocks described herein can be fabricated in some cases from approximately half the material, while retaining full functionality, as compared to many traditional wall blocks. Except where physically impossible, any of the features of any of the embodiments described herein can be used with any of the other embodiments described herein. Any of the concrete components described herein can be fabricated as wet-cast or dry-cast concrete components. As used herein, the term "integral" or "integrally" means that the components referred to are formed and cured together in the same mold (from wet-cast concrete or dry-cast concrete) rather than formed separately and then attached to one another at a later time.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A wall block assembly comprising:

a face block comprising a face portion and first and second leg portions formed integrally with the face portion, the face portion and the first and second leg portions comprise a one-piece, seamless construction, wherein each leg portion extends away from the face portion to a rear portion of the leg portion, the rear portion of each leg portion defining a rear surface at the rearmost end of the leg portion; and a trunk block comprising first and second end portions and an intermediate portion which interconnects the first and second end portions, wherein the first end portion is connected to the rear portion of the first leg portion such that the first end portion of the trunk block is held against the rear surface of the first leg portion and the second end portion is connected to the rear portion of the second leg portion such that the second end portion of the trunk block is held against the rear surface of the second leg portion, and wherein the face portion, first leg portion, second leg portion, and the trunk block define an enclosed space in a horizontal plane to receive backfill material;

wherein the face block and the trunk block are separate components that are not casted to each other;

a first connecting element connecting the rear portion of the first leg portion of the face block to the first end portion of the trunk block, wherein the first connecting element is a separate component from the face block and the trunk block.

2. The wall block assembly of claim 1, wherein the face block comprises wet-cast concrete.

3. The wall block assembly of claim 1, wherein the face block comprises dry-cast concrete.

4. The wall block assembly of claim 1, further comprising a second connecting element connecting the rear portion of the second leg portion of the face block to the second end portion of the trunk block, wherein the second connecting element is a separate component from the face block and the trunk block.

5. The wall block assembly of claim 4, wherein the first and second connecting elements are made from non-concrete materials.

6. The wall block assembly of claim 4, wherein the first and second connecting elements comprise a metal or polymer.

7. The wall block assembly of claim 1, wherein the face block has a front face surface area of at least 5.0 sq. feet.

8. The wall block assembly of claim 7, wherein the face block has a weight of less than 1,000 lbs.

9. The wall block assembly of claim 8, wherein the face block has a face area ratio of less than 1.0 foot.

10. A wall block assembly comprising:

a face block comprising a face portion and first and second leg portions formed integrally with the face portion, wherein each leg portion extends away from the face portion to a rear portion of the leg portion;

a trunk block comprising first and second end portions and an intermediate portion which interconnects the first and second end portions, wherein the first end portion is connected to the rear portion of the first leg portion and the second end portion is connected to the rear portion of the second leg portion, and wherein the face portion, first leg portion, second leg portion, and the trunk block define an enclosed space in a horizontal plane to receive backfill material; and a first connecting element, wherein the rear portion of the first leg portion of the face block comprises two ridges in an upper surface of the first leg portion and a slot defined between the two ridges, and wherein a portion of the first connecting element is disposed in the slot.

11. The wall block assembly of claim 10, wherein the first end portion of the trunk block comprises at least one slot in an upper surface of the first end portion, wherein another portion of the first connecting element is disposed in the slot in the first end portion.

12. The wall block assembly of claim 11, wherein the first connecting element comprises first and second end portions, the first end portion of the first connecting element is positioned to engage at least one of the ridges of the first leg portion, and the second end portion of the first connecting element is positioned to engage an adjacent surface of the trunk block.

13. The wall block of claim 11, wherein:

the rear portion of the first leg portion of the face block further comprises a pocket defined between the two ridges wherein the pocket has a width which is greater than a width of the slot defined between the two ridges of the rear portion of the first leg portion;

the first end portion of the trunk block comprises three slots and a pocket which interconnects the three slots; and the first connecting element extends from the pocket of the rear portion of the first leg portion of the face block to the pocket of the first end portion of the trunk block.

14. A wall block assembly comprising:

a face block comprising a face portion and first and second leg portions formed integrally with the face portion, the face portion and the first and second leg portions comprise a one-piece, seamless construction, wherein each leg portion extends away from the face portion to a rear portion of the leg portion, the rear portion of each leg portion defining a rear surface at the rearmost end of the leg portion, and each leg portion having a length extending from the face portion to its rear portion and a width extending perpendicular to the length, the length of each leg portion being greater than its width;

a first trunk block comprising first and second end portions and an intermediate portion which interconnects the first and second end portions, wherein the first end portion is coupled to the rear portion of the first leg portion of the face block such that the first end portion of the first trunk block is held against the rear surface of the first leg portion, the first trunk block having a length extending from its first end portion to its second end portion and a width extending perpendicular to the length, the length being greater than its width, the first trunk block extending from the first leg portion such that the length of the first trunk block is parallel to the length of the first leg portion; and a second trunk block comprising first and second end portions and an intermediate portion which interconnects the first and second end portions, wherein the first end portion of the second trunk block is coupled to the rear portion of the second leg portion of the face block such that the first end portion of the second trunk block is held against the rear surface of the second leg portion, the second trunk block having a length extending from its first end portion to its second end portion and a width extending perpendicular to the length, the length being greater than its width, the second trunk block extending from the second leg portion such that the length of the second trunk block is parallel to the length of the second leg portion;

wherein the face block, the first trunk block and the second trunk block are separate components that are not casted to each other.

15. The wall block assembly of claim 14, wherein the first and second leg portions of the face block extend from quarter points of the face portion of the face block.

16. The wall block assembly of claim 14, further comprising a first pocket formed in a top surface of the face portion of the face block and a second pocket formed in a bottom surface of the face portion of the face block, and wherein each of the first and second pockets are adapted to receive a block-connecting element.

17. The wall block assembly of claim 16, wherein the first and second pockets are situated at quarter points of the face portion of the face block.

18. The wall block assembly of claim 14, further comprising:

a first connecting element connecting the rear portion of the first leg portion of the face block to the first end portion of the first trunk block, wherein the first connecting element is a separate component from the face block and the first trunk block; and a second connecting element connecting the rear portion of the second leg portion of the face block to the first end portion of the second trunk block, wherein the second connecting element is a separate component from the face block and the second trunk block.

19. The wall block assembly of claim 14, wherein the second end portions of the trunk blocks are spaced apart from each other.

20. A method of assembling a wall block assembly comprising:

positioning a face block in a desired position, wherein the face block comprises a face portion and first and second leg portions formed integrally with the face portion, the face portion and the first and second leg portions comprise a one-piece, seamless construction, wherein each leg portion extends away from the face portion to a rear portion of the leg portion, the rear portion of each leg portion defining a vertically oriented rear surface at the rearmost end of the leg portion;

positioning a trunk block in a desired position relative to the face block such that the rear surface of the first leg portion is against a first end portion of the trunk block and the rear surface of the second leg portion is against a second end portion of the trunk block, wherein the face block and the trunk block are separate concrete components that are not casted to each other;

connecting the rear portion of the first leg portion to the first end portion of the trunk block with a first connecting element that is a separate component from the face block and the trunk block; and connecting the rear portion of the second leg portion to the second end portion of the trunk block with a second connecting element that is a separate component from the face block and the trunk block.

21. A method of assembling a wall block assembly comprising:

positioning a face block in a desired position, wherein the face block comprises a face portion and first and second leg portions formed integrally with the face portion, wherein each leg portion extends away from the face portion to a rear portion of the leg portion;

positioning a trunk block in a desired position relative to the face block such that the rear portion of the first leg portion is adjacent to a first end portion of the trunk block and the rear portion of the second leg portion is adjacent to a second end portion of the trunk block;

connecting the rear portion of the first leg portion to the first end portion of the trunk block; and connecting the rear portion of the second leg portion to the second end portion of the trunk block wherein:

the rear portion of the first leg portion of the face block includes a slot;

the first end portion of the trunk block includes a slot; and the act of connecting the rear portion of the first leg portion to the first end portion of the trunk block comprises inserting a connecting element into the slot in the rear portion of the first leg portion and the slot of the first end portion of the trunk block.

22. The method of claim 21, wherein:

the rear portion of the second leg portion of the face block includes a slot;

the second end portion of the trunk block includes a slot; and the act of connecting the rear portion of the second leg portion to the second end portion of the trunk block comprises inserting a connecting element into the slot in the rear portion of the second leg portion and the slot of the second end portion of the trunk block.

* * * * *